US008881346B2

(12) United States Patent
Oshima et al.

(10) Patent No.: US 8,881,346 B2
(45) Date of Patent: Nov. 11, 2014

(54) HINGE DEVICE AND BASE FOR HINGE DEVICE

(75) Inventors: Kazuyoshi Oshima, Tokyo (JP); Shingo Takamatsu, Tokyo (JP); Ken Shinmura, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 13/882,023

(22) PCT Filed: Oct. 27, 2011

(86) PCT No.: PCT/JP2011/074764

§ 371 (c)(1),
(2), (4) Date: Apr. 26, 2013

(87) PCT Pub. No.: WO2012/057249

PCT Pub. Date: May 3, 2012

(65) Prior Publication Data

US 2013/0219659 A1 Aug. 29, 2013

(30) Foreign Application Priority Data

Oct. 29, 2010 (JP) ..... 2010-243624

(51) Int. Cl.

| | |
|---|---|
| ***E05D 7/04*** | (2006.01) |
| ***E05D 5/00*** | (2006.01) |
| ***E05D 11/00*** | (2006.01) |
| ***E05D 11/10*** | (2006.01) |
| ***E05D 7/00*** | (2006.01) |
| *E05D 7/12* | (2006.01) |

(52) U.S. Cl.

CPC ..... *E05D 7/0009* (2013.01); *E05D 7/125* (2013.01); *E05D 2007/0492* (2013.01); *E05D 7/0407* (2013.01); *E05D 7/0415* (2013.01)

USPC ..... 16/236; 16/238; 16/242; 16/382

(58) Field of Classification Search

CPC ..... E05D 1/00; E05D 7/0407; E05D 7/0423; E05F 1/1207; E05F 1/1215

USPC ..... 16/277, 286, 295, 302, 240, 238, 245, 16/256, 258, 236, 242, 382

See application file for complete search history.

(56) References Cited

U.S. PATENT DOCUMENTS 4,227,284 A * 10/1980 Zernig ..... 16/238
5,245,727 A * 9/1993 Sasaki ..... 16/258

(Continued)

FOREIGN PATENT DOCUMENTS

JP 10-306643 A 11/1998
JP 2009-523937 A 6/2009
JP 4437303 B2 3/2010

OTHER PUBLICATIONS

International Search Report issued in PCT/JP2011/074764 mailed on Dec. 13, 2011 (2 pages)

*Primary Examiner* — Victor Batson
*Assistant Examiner* — Jason W San
(74) *Attorney, Agent, or Firm* — Osha Liang LLP

(57) ABSTRACT

A hinge device has a base, a body removably provided at the base, and a mounting member rotatably connected to the body. The base has a base member, a first movable member disposed at the base member such that the first movable member is movable in a first direction and non-movable in a second direction orthogonal to the first direction, and a second movable member disposed at the first movable member such that the second movable member is movable in the second direction and non-movable in the first direction, and the body removably attached to the second movable member. A first position adjustment mechanism is provided between the base member and the first movable member. The first position adjustment mechanism adjusts position of the first movable member with respect to the base member in the first direction.

8 Claims, 34 Drawing Sheets

(56) References Cited

U.S. PATENT DOCUMENTS

| | | | | |
|---|---|---|---|---|
| 6,148,479 | A * | 11/2000 | Lin | 16/258 |
| 6,557,211 | B2 * | 5/2003 | Salice | 16/382 |
| 6,615,452 | B2 * | 9/2003 | Mueller et al. | 16/242 |
| 6,637,073 | B2 * | 10/2003 | Kincaid | 16/250 |
| 6,647,591 | B1 * | 11/2003 | Domenig et al. | 16/242 |
| 6,845,544 | B2 * | 1/2005 | Hofer | 16/246 |
| 6,880,205 | B2 * | 4/2005 | Rupprechter | 16/235 |
| 6,901,633 | B2 * | 6/2005 | Chen | 16/240 |
| 6,918,158 | B2 * | 7/2005 | Isele | 16/235 |
| 6,996,877 | B2 * | 2/2006 | Booker et al. | 16/257 |
| 7,017,231 | B2 * | 3/2006 | Isele | 16/242 |
| 7,117,561 | B1 * | 10/2006 | Domenig et al. | 16/236 |
| 7,213,300 | B1 * | 5/2007 | Domenig et al. | 16/236 |
| 7,231,691 | B1 * | 6/2007 | Domenig et al. | 16/236 |
| 7,516,516 | B2 * | 4/2009 | Wu | 16/242 |
| 7,614,116 | B2 * | 11/2009 | Chen et al. | 16/238 |
| 7,653,967 | B2 * | 2/2010 | Lowe et al. | 16/238 |
| 8,205,298 | B2 * | 6/2012 | Lin et al. | 16/287 |
| 8,250,705 | B2 * | 8/2012 | Oshima | 16/236 |
| 8,276,241 | B2 * | 10/2012 | Wu et al. | 16/238 |
| 2001/0044987 | A1 * | 11/2001 | Salice | 16/382 |
| 2001/0047566 | A1 * | 12/2001 | Salice | 16/242 |
| 2002/0166207 | A1 * | 11/2002 | Egger et al. | 16/240 |
| 2003/0061682 | A1 * | 4/2003 | Muellller et al. | 16/238 |
| 2003/0093877 | A1 * | 5/2003 | Hofer | 16/235 |
| 2003/0204934 | A1 * | 11/2003 | Mueller et al. | 16/236 |
| 2004/0006847 | A1 * | 1/2004 | Larsen et al. | 16/257 |
| 2004/0163211 | A1 * | 8/2004 | Rucker | 16/235 |
| 2004/0163213 | A1 * | 8/2004 | Isele | 16/245 |
| 2005/0172456 | A1 * | 8/2005 | Migli | 16/382 |
| 2007/0136988 | A1 * | 6/2007 | Bullock | 16/245 |
| 2007/0289094 | A1 * | 12/2007 | Lowe et al. | 16/238 |
| 2008/0016648 | A1 * | 1/2008 | Lautenschlager | 16/238 |
| 2008/0271291 | A1 * | 11/2008 | Chen et al. | 16/238 |
| 2009/0139055 | A1 | 6/2009 | Salice | |
| 2011/0083299 | A1 * | 4/2011 | Krudener | 16/319 |

* cited by examiner

HINGE DEVICE AND BASE FOR HINGE DEVICE

FIELD OF THE INVENTION

The present invention generally relates to a hinge device for rotatably connecting a door to a frame, and particularly relates to a hinge device in which a position of the door with respect to the frame can be adjusted and a base for such a hinge device.

BACKGROUND OF THE INVENTION

As disclosed in Patent Document 1 listed below, a hinge device generally includes a base to be mounted to a frame, a body removably attached to the base and a mounting member to be mounted to a door. The mounting member is rotatably connected to a front end portion of the body via a pair of links. Therefore, when the body is attached to the base, the door is rotatably supported by the frame via the hinge device.

The base includes a base member to be mounted to the frame, a first movable member disposed at the base member such that a position of the first movable member can be adjusted in a vertical direction and a second movable member disposed at the first movable member such that a position of the second movable member can be adjusted in a front-rear direction. The body is removably attached to the second movable member. Accordingly, by adjusting the position of the first movable member in the vertical direction and adjusting the position of the second position adjustment member in a left-right direction, a position of the body can be adjusted in the vertical direction and in the left-right direction, and therefore, a position of the door with respect to the frame can be adjusted in the vertical direction and in the left-right direction.

PRIOR ART DOCUMENTS

Patent Documents

Patent Document 1: Japanese Unexamined Patent Application Publication No. H10-306643

SUMMARY OF THE INVENTION

Problem to be Solved by the Invention

In a conventional hinge device, to adjust a position of a body with respect to a base member in a vertical direction and/or a front-rear direction, it is required that a first movable member and/or a second movable member be directly moved in a desired direction through a desired distance. However, it is difficult to precisely place the body at a desired position.

Solution to the Problem

To solve the problem mentioned above, a first aspect of the present invention provides a hinge device including: a base; a body removably provided at the base; and a mounting member rotatably connected to the body; the base including: a base member; a first movable member disposed at the base member such that the first movable member is movable in a first direction and non-movable in a second direction orthogonal to the first direction; and a second movable member disposed at the first movable member such that the second movable member is movable in the second direction and non-movable in the first direction; and the body removably attached to the second movable member, wherein: a first position adjustment mechanism is provided between the base member and the first movable member, the first position adjustment mechanism adjusts position of the first movable member with respect to the base member in the first direction, a second position adjustment mechanism is provided between the base member and the second movable member, the second position adjustment mechanism adjusts position of the second movable member with respect to the base member and the first movable member in the second direction; the first position adjustment mechanism comprises a first adjustment shaft and a first adjustment engagement portion, the first adjustment shaft is provided at one of the base member and the first movable member such that the first adjustment shaft is rotatable about a first rotational axis extending in a third direction orthogonal to the first direction and the second direction and the first adjustment shaft is non-movable in the first direction, the first adjustment engagement portion is provided in the other of the base member and the first movable member, a first eccentric shaft decentered with respect to the first rotational axis is provided at the first adjustment shaft, the first eccentric shaft is engaged with the first adjustment engagement portion such that the first eccentric shaft is non-movable in the first direction and movable in the second direction; and, the second position adjustment mechanism comprises a second adjustment shaft and a second adjustment engagement portion, the second adjustment shaft is provided at one of the base member and the second movable member such that the second adjustment shaft is rotatable about a second rotational axis extending parallel to the first rotational axis and the second adjustment shaft is non-movable in the second direction, the second adjustment engagement portion is provided in the other of the base member and the second movable member, a second eccentric shaft decentered with respect to the second rotational axis is provided at the second adjustment shaft, the second eccentric shaft is engaged with the second adjustment engagement portion such that the second eccentric shaft is movable in the first direction and non-movable in the second direction.

In this case, it is preferable that the first adjustment shaft is provided at the first movable member, the first adjustment engagement portion is provided in the base member, the second adjustment shaft is provided at the second movable member and the second adjustment engagement portion is provided in the base member.

Preferably, the first adjustment shaft is provided at the first movable member such that the first adjustment shaft is movable in the second direction and the first adjustment shaft and the second adjustment shaft are connected to each other such that the first adjustment shaft and the second adjustment shaft are non-movable in the second direction.

Preferably, a guide member is provided at the first movable member such that the guide member is non-movable in the first direction and movable in the second direction, the first adjustment shaft is provided at the guide member such that the first adjustment shaft is rotatable about the first rotational axis and non-movable in the first direction and in the second direction, the second adjustment shaft is provided at the guide member such that the second adjustment shaft is rotatable about the second rotational axis and non-movable in the first direction and in the second direction, and the first adjustment shaft and the second adjustment shaft are non-movably connected to each other via the guide member.

Preferably, the guide member is provided at the first movable member such that the guide member is movable in the second direction with a frictional resistance of a predetermined magnitude working between the guide member and the first movable member.

To solve the problem mentioned above, a second aspect of the present invention provides a base for a hinge device including: a base member; a first movable member disposed at the base member such that the first movable member is movable in a first direction and non-movable in a second direction orthogonal to the first direction; and a second movable member disposed at the first movable member such that the second movable member is movable in the second direction and non-movable in the first direction; and a body removably attached to the second movable member, the body having a mounting member rotatably connected to the body, wherein: a first position adjustment mechanism is provided between the base member and the first movable member, the first position adjustment mechanism adjusts position of the first movable member with respect to the base member in the first direction, a second position adjustment mechanism is provided between the base member and the second movable member, the second position adjustment mechanism adjusts position of the second movable member with respect to the base member and the first movable member in the second direction; the first position adjustment mechanism comprises a first adjustment shaft and a first adjustment engagement portion, the first adjustment shaft is provided at one of the base member and the first movable member such that the first adjustment shaft is rotatable about a first rotational axis extending in a third direction orthogonal to the first direction and the second direction and the first adjustment shaft is non-movable in the first direction, the first adjustment engagement portion is provided in the other of the base member and the first movable member, a first eccentric shaft decentered with respect to the first rotational axis is provided at the first adjustment shaft, the first eccentric shaft is engaged with the first adjustment engagement portion such that the first eccentric shaft is non-movable in the first direction and movable in the second direction; and, the second position adjustment mechanism comprises a second adjustment shaft and a second adjustment engagement portion, the second adjustment shaft is provided at one of the base member and the second movable member such that the second adjustment shaft is rotatable about a second rotational axis extending parallel to the first rotational axis and the second adjustment shaft is non-movable in the second direction, the second adjustment engagement portion is provided in the other of the base member and the second movable member, a second eccentric shaft decentered with respect to the second rotational axis is provided at the second adjustment shaft, the second eccentric shaft is engaged with the second adjustment engagement portion such that the second eccentric shaft is movable in the first direction and non-movable in the second direction.

In this case, it is preferable that the first adjustment shaft is provided at the first movable member, the first adjustment engagement portion is provided in the base member, the second adjustment shaft is provided at the second movable member and the second adjustment engagement portion is provided in the base member.

Preferably, the first adjustment shaft is provided at the first movable member such that the first adjustment shaft is movable in the second direction and the first adjustment shaft and the second adjustment shaft are connected to each other such that the first adjustment shaft and the second adjustment shaft are non-movable in the second direction.

Preferably, a guide member is provided at the first movable member such that the guide member is non-movable in the first direction and movable in the second direction, the first adjustment shaft is provided at the guide member such that the first adjustment shaft is rotatable about the first rotational axis and non-movable in the first direction and in the second direction, the second adjustment shaft is provided at the guide member such that the second adjustment shaft is rotatable about the second rotational axis and non-movable in the first direction and in the second direction, and the first adjustment shaft and the second adjustment shaft are non-movably connected to each other via the guide member.

Preferably, the guide member is provided at the first movable member such that the guide member is movable in the second direction with a frictional resistance of a predetermined magnitude working between the guide member and the first movable member.

Advantageous Effects of the Invention

In the present invention having the features mentioned above, when the first adjustment shaft is moved in normal and reverse directions, the first eccentric shaft is revolved about the first rotational axis. Moreover, the first eccentric shaft is engaged with the first adjustment engagement portion such that the first eccentric shaft is non-movable in the first direction and movable in the second direction. Therefore, when the first adjustment shaft is rotated, the first movable member is moved with respect to the base member in the first direction. An amount of position adjustment of the first movable member in the first direction can be adjusted by an amount of rotation of the first adjustment shaft. The amount of rotation of the first adjustment shaft can be easily and precisely adjusted with rotation tools such as drivers. Thus, the position of the first movable member in the first direction can be easily and precisely adjusted. The same applies to the adjustment of a position of the second movable member in the second direction.

DESCRIPTION OF THE PREFERRED EMBODIMENTS

Figure 1:
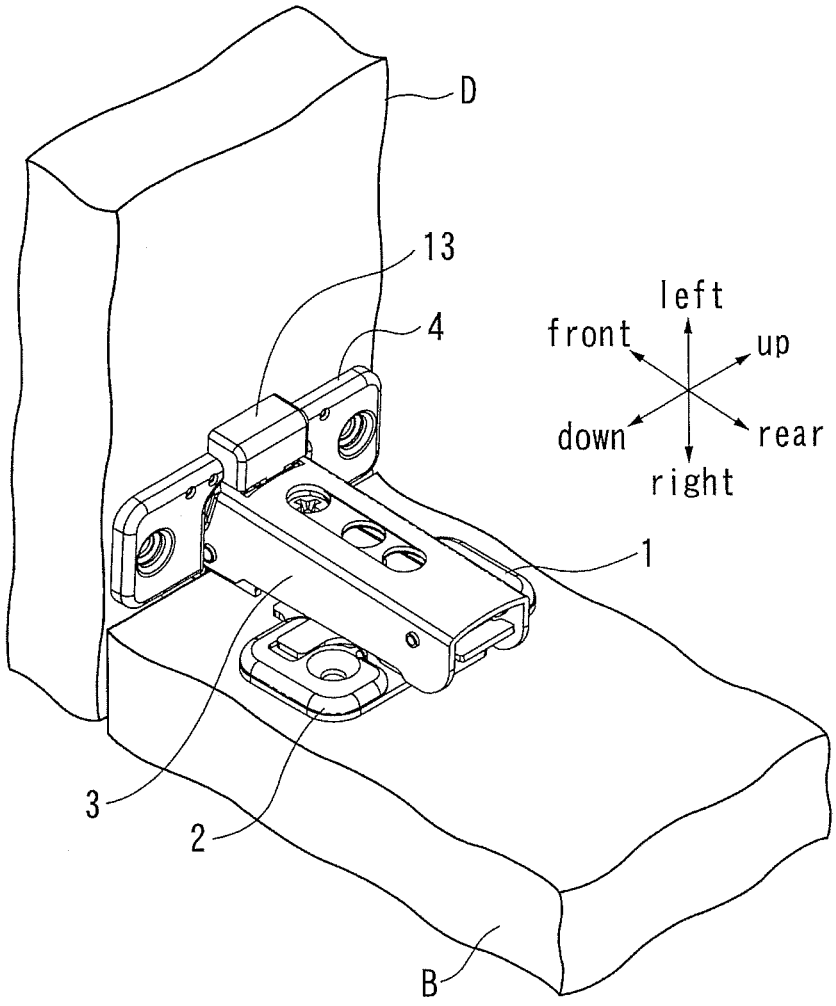
FIG. 1 is a perspective view of a first embodiment of the present invention, showing a hinge device mounted to a frame and a door.
Figure 2:
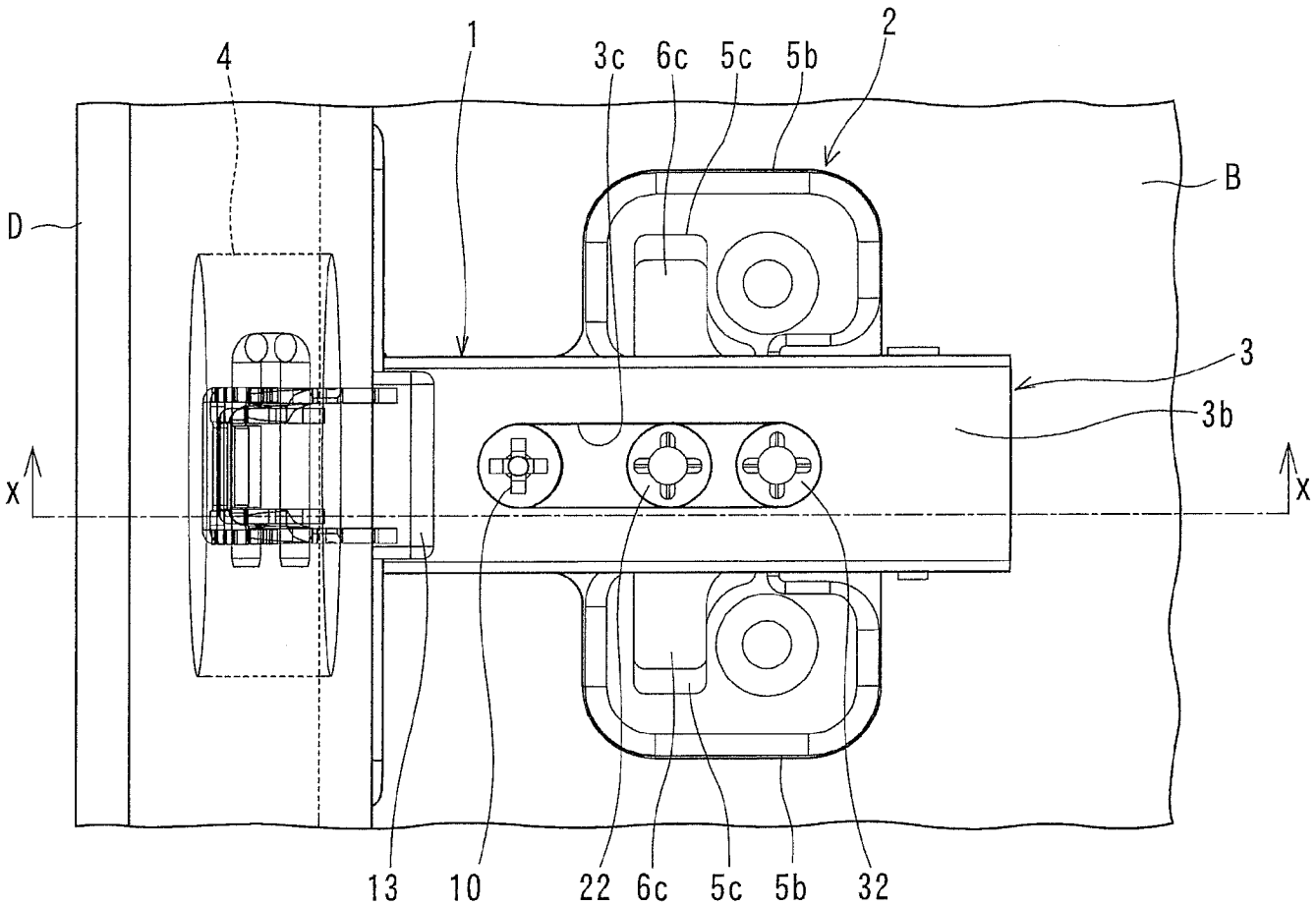
FIG. 2 is a side view of the first embodiment, showing the hinge device mounted to the frame and the door.

A best mode for carrying out the invention will be described hereinafter with reference to the drawings.

FIGS. 1 to 28 show a first embodiment of the present invention. A hinge device 1 of this embodiment includes a base 2, a body 3 and a mounting member 4 as shown in FIGS. 1 to 14.

The base 2 is fixed to a front end portion of an inner surface of a right side wall of a frame B. The frame B has an opening in a front surface portion thereof. The body 3 is removably attached to the base 2. The mounting member 4 is attached to a right end portion of a rear surface of a door D. The mounting member 4 is connected to an end portion in a front side (to be referred to as "front end portion" hereinafter) of the body 3 via an internal link 71 and an external link 72 to be described later such that the mounting member 4 is rotatable in a horizontal direction. By this arrangement, the door D is mounted to the frame B via the hinge device 1 such that the door D is rotatable in the horizontal direction. The door D is rotatable between a closed position shown in FIGS. 1 to 3, in which an opening of the frame B is closed, and an open position in which the opening of the frame B is open. Directions used in describing features of the first embodiment and other embodiments to be described later refer to a front-rear direction, a left-right direction and a vertical direction of the frame B shown in FIG. 1. It is to be understood that the present invention is not limited by specific directions.

Figure 10:
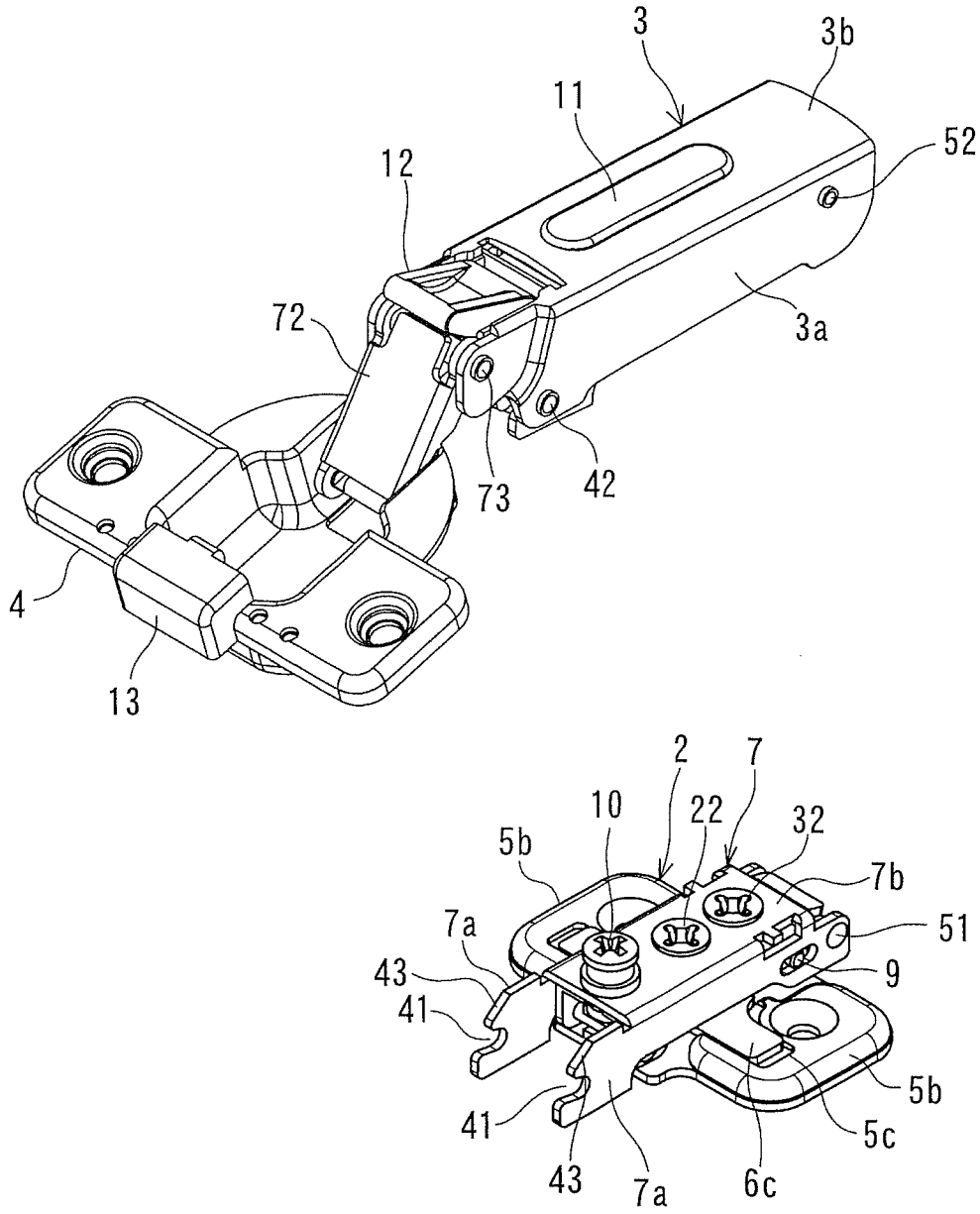
FIG. 10 is a perspective view of the first embodiment, showing a body removed from a base.
Figure 11:
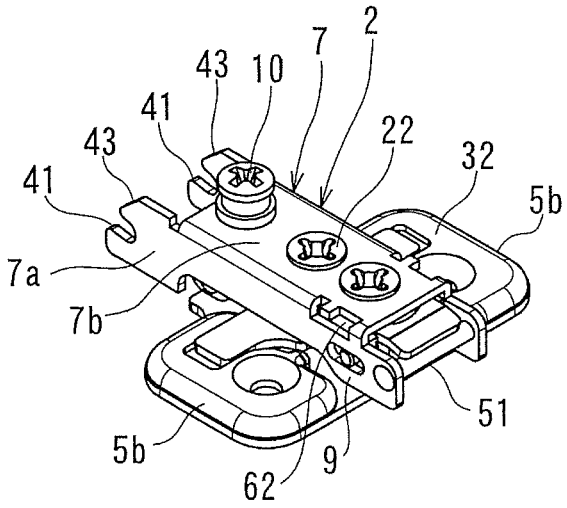
FIG. 11 is a perspective view of the first embodiment, showing the body removed from the base, viewed from a different angle from that of FIG. 10.
Figure 11:
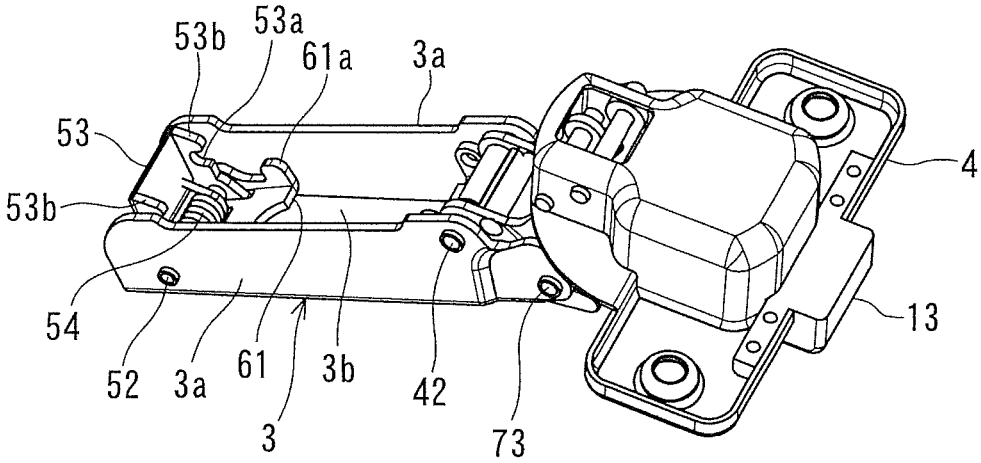
Figure 15:
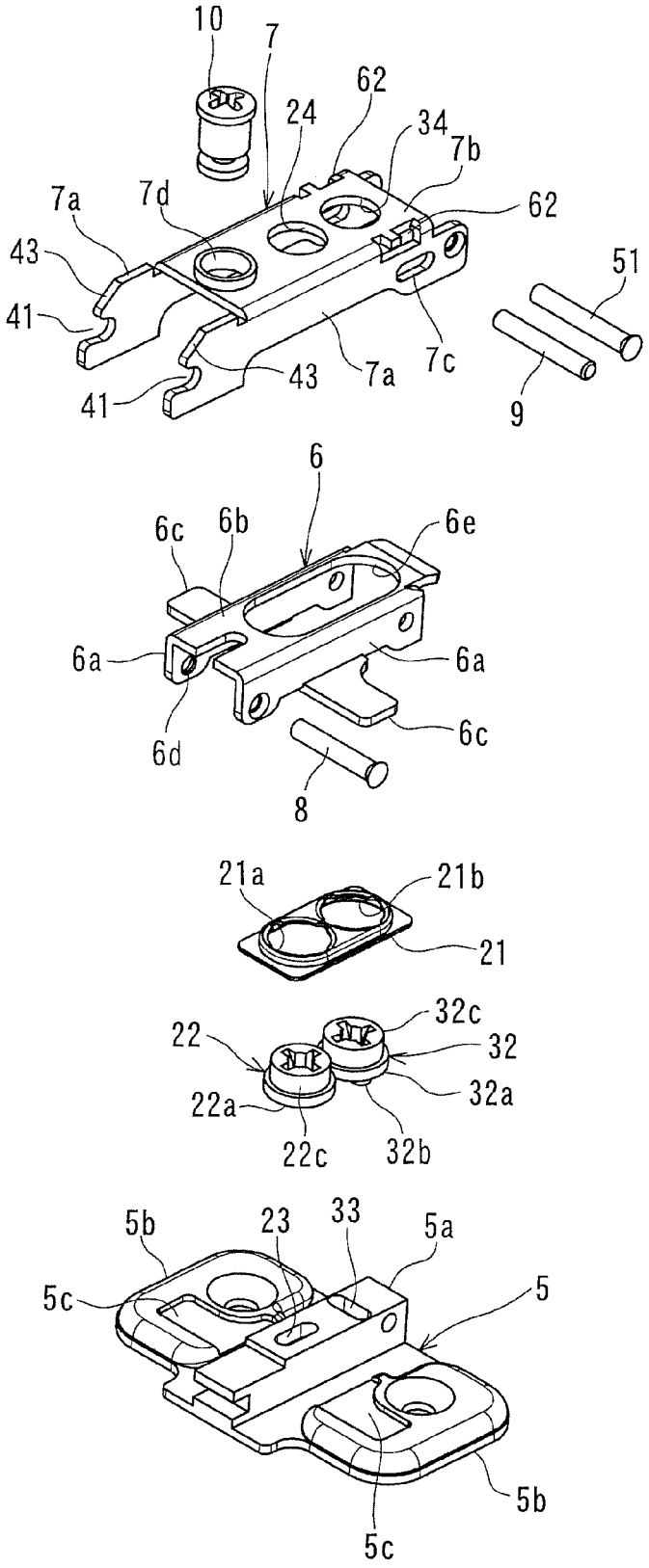
FIG. 15 is an exploded perspective view of the base according to the first embodiment.
Figure 16A:
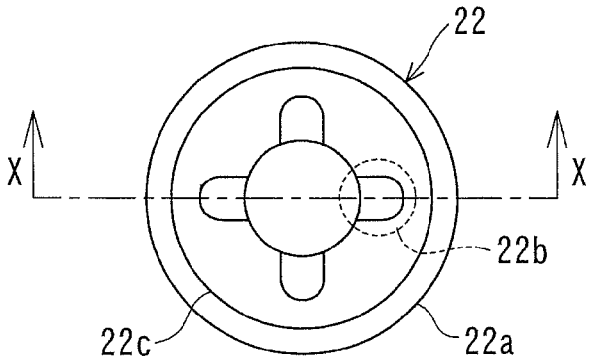
FIG. 16A is a plan view of a first adjustment shaft used in the first embodiment.
Figure 16B:
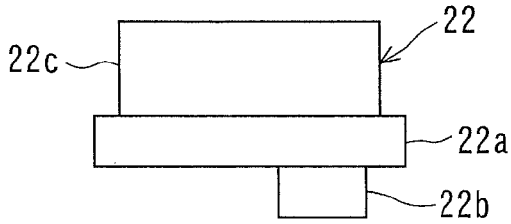
FIG. 16B is a front view of the first adjustment shaft.
Figure 16C:
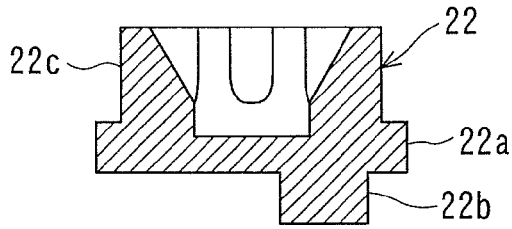
FIG. 16C is a cross-sectional view of the first adjustment shaft taken along line X-X of FIG. 16A.
Figure 16D:
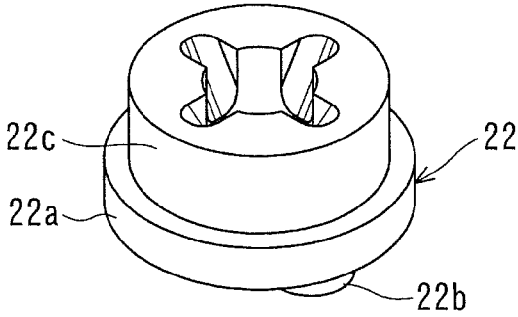
FIG. 16D is a perspective view of the first adjustment shaft.

As particularly shown in FIGS. 10, 11 and 15, the base 2 includes a base member 5, a first movable member 6 and a second movable member 7.

As particularly shown in FIG. 15, the base member 5 includes a support part 5*a* having a generally quadrangular cross-section. A longitudinal direction of the support part 5*a* is oriented in the front-rear direction (the left-right direction, diagonally up and right, in FIG. 15). The support part 5*a* is solid. Alternatively, the support part 5*a* may be hollow having a U-shaped cross section. In this case, the support part 5*a* is disposed with an open portion of the support part 5*a* oriented toward the right side wall of the frame B. Fixing plates 5*b*, 5*b* respectively projecting upward and downward are respectively formed in opposite side surfaces of the support part 5*a* facing upward and downward (leftward and rightward, diagonally down and right, in FIG. 15). The base member 5 is fixed to the inner surface of the right side wall of the frame B by tightening a screw (not shown) screwed into the right side wall of the frame B passing through the fixing plates 5*b*, 5*b*.

The first movable member 6 includes two side plates 6*a*, 6*a* opposed to each other and a top plate 6*b* connecting the side plates 6*a*, 6*a*. The side plates 6*a*, 6*a* are disposed with a longitudinal direction thereof oriented in the front-rear direction and a thickness direction thereof oriented in the vertical direction. Accordingly, the side plates 6*a*, 6*a* are opposed to each other in the vertical direction. The top plate 6*b* connects left end portions (upper end portions in FIG. 15) of the side plates 6*a*, 6*a* to form one member. As a result, the first movable member 6 has a generally U-shaped cross-sectional configuration composed of the side plates 6*a*, 6*a* and the top plate 6*b*.

The support part 5*a* of the base member 5 is disposed between the side plates 6*a*, 6*a* of the first movable member 6. A distance between inner surfaces of the side plates 6*a*, 6*a* is greater than a width of the support part 5*a* in the vertical direction. Therefore, the first movable member 6 is movable in the vertical direction (first direction) with respect to the base member 5 by a distance corresponding to a difference between the distance between the side plates 6*a*, 6*a* and the width of the support part 5*a* in the vertical direction.

Guide parts 6*c*, 6*c* respectively projecting upward and downward are provided in a middle portion of the side plates 6*a*, 6*a* of the first movable member 6 in the front-rear direction. The guide parts 6*c*, 6*c* are respectively disposed in guide recesses 5*c*, 5*c* respectively formed in the fixing plates 5*b*, 5*b* of the base member 5 such that the guide parts 6*c*, 6*c* are movable in the vertical direction and non-movable in the front-rear direction. Accordingly, the first movable member 6 is movable in the vertical direction but non-movable in the front-rear direction (second direction) with respect to the base member 5. A front end portion and a rear end portion of the first movable member 6 are connected to the base member 5 via securing shafts 8, 9 such that the front end portion and the rear end portion of the first movable member 6 are movable in the vertical direction but non-movable in the front-rear direction and in the left-right direction. Accordingly, the first movable member 6 is movable with respect to the base member 5 only in the vertical direction and non-movable in the front-rear direction and in the left-right direction. Position of the first movable member 6 with respect to the base member 5 in the vertical direction is adjusted by a first position adjustment mechanism 20 to be described later.

As with the first movable member 6, the second movable member 7 includes a pair of side plates 7*a*, 7*a* opposed to each other in the vertical direction and a top plate 7*b* connecting left end portions of the pair of side plates 7*a*, 7*a* to form one member. The side plates 6*a*, 6*a* and the top plate 6*b* of the first movable member 6 are disposed between the pair of side plates 7*a*, 7*a*. A distance between inner surfaces of the pair of side plates 7*a*, 7*a* is generally the same as a distance between outer surfaces of the pair of side plates 6*a*, 6*a* of the first movable member 6. By this arrangement, the second movable member 7 is movable in the front-rear direction (second direction) but non-movable in the vertical direction (first direction) with respect to the first movable member 6. Therefore, the second movable member 7 is moved together with the first movable member 6 in the vertical direction with respect to the base member 5 but the second movable member 7 is moved independently of the base member 5 and the first movable member 6 in the front-rear direction.

Figure 20:
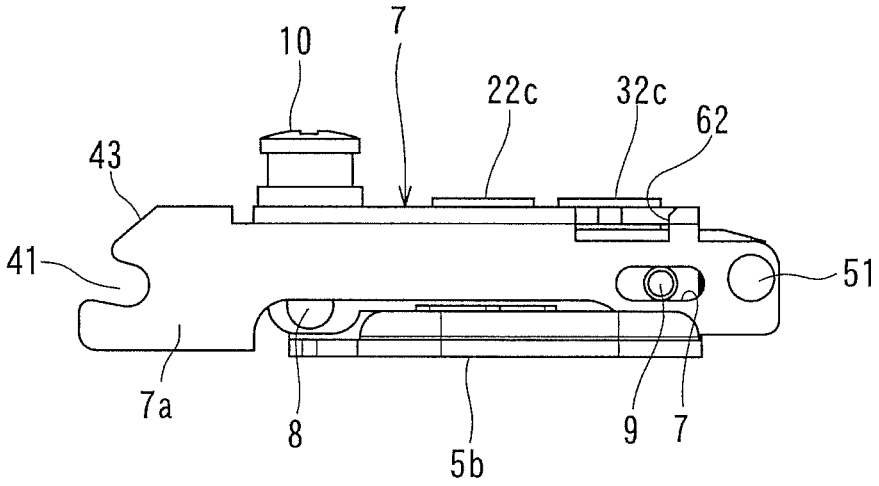
FIG. 20 is a view on arrow X of FIG. 19.

An elongated hole 7*c* extending in the front-rear direction is formed in a rear end portion of each of the side plates 7*a*, 7*a* of the second movable member 7. Upper and lower end portions of a securing shaft 9 respectively passing through the side plates 6*a*, 6*a* of the first movable member 6 are respectively disposed in the elongated holes 7*c*, 7*c* such that the upper and lower end portions of the securing shaft 9 are respectively rotatable and movable in a longitudinal direction of the elongated holes 7*c*, 7*c*. A screw hole 7*d* having an axis thereof oriented in the left-right direction is formed in a front end portion of the top plate 7*b*. An adjustment screw 10 having an axis thereof oriented in the left-right direction is threadably engaged with the screw hole 7*d*. A right end portion (lower end portion in FIG. 15) of the adjustment screw 10 is engaged with an engagement groove 6*d* formed in a front end portion of the top plate 6*b* of the first movable member 6. The engagement groove 6*d* extends in the front-rear direction. The adjustment screw 10 is engaged with the engagement groove 6*d* such that the adjustment screw 10 is movable in the front-rear direction but non-movable in the vertical direction and the left-right direction. Accordingly, when the adjustment screw 10 is rotated in normal and reverse directions, a front end portion of the second movable member 7 is rotated about the securing shaft 9 in the left-right direction as shown in FIGS. 20 to 22, thereby adjusting the position of the front end portion of the second movable member 7 in the left-right direction.

Figure 21:
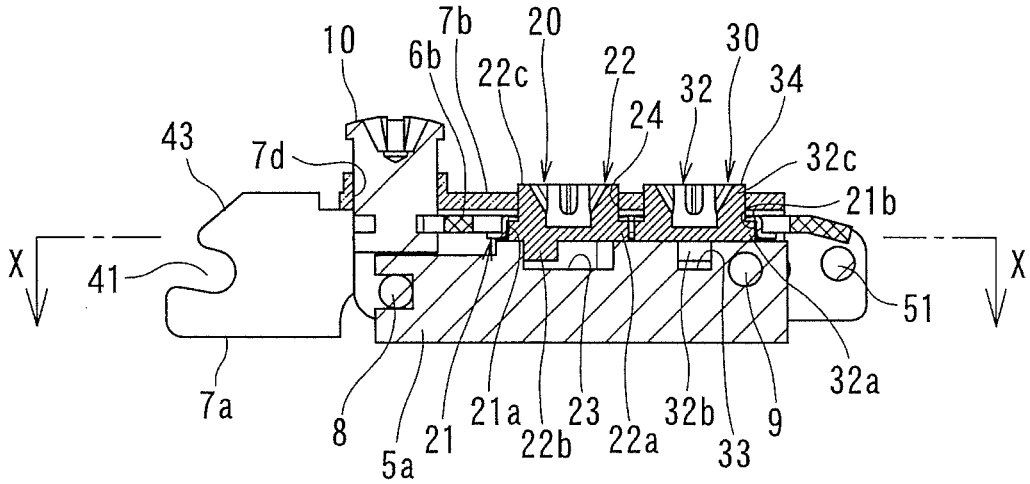
FIG. 21 is a cross-sectional view taken along line Y-Y of FIG. 19.
Figure 22:
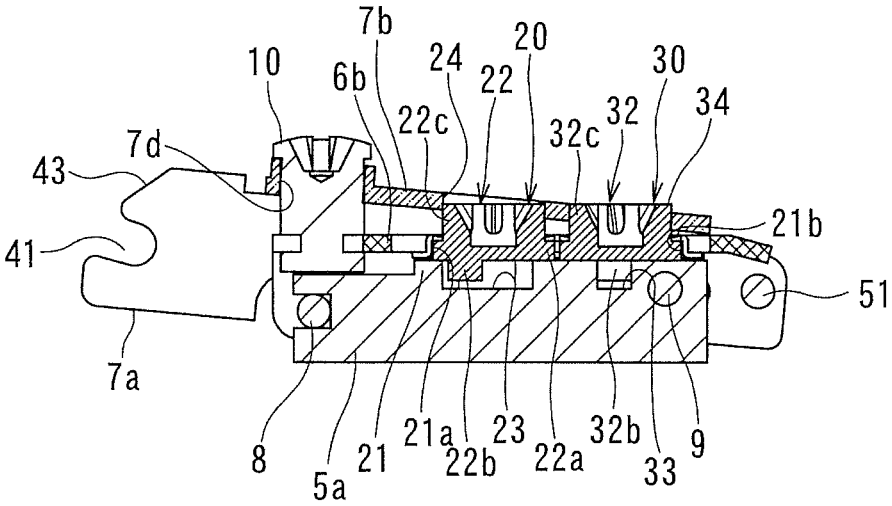
FIG. 22 is a cross-sectional view similar to FIG. 21, showing a front end portion of the body spaced maximally from a front end portion of the base.

As shown in FIGS. 21 and 22, the first position adjustment mechanism 20 is provided between the base member 5 and the first movable member 6. The first position adjustment mechanism 20 is provided for adjusting the position of the first movable member 6 with respect to the base member 5 in the vertical direction. The first position adjustment mechanism 20 includes a guide plate (guide member) 21 and a first adjustment shaft 22.

As shown in FIG. 15, the guide plate 21 has a shape of a generally rectangular flat plate elongated in the front-rear direction. The guide plate 21 is disposed with a thickness direction thereof oriented in the left-right direction. A width of the guide plate 21, specifically, a width of the guide plate 21 in the vertical direction is designed to be slightly wider than a width of a guide hole 6*e* in the vertical direction. The guide hole 6*e* is formed in the top plate 6*b* of the first movable member 6 and extends in the front-rear direction. The guide plate 21 is press-fitted in the guide hole 6*e* such that the guide plate 21 is movable in the front-rear direction and non-movable in the vertical direction. Accordingly, the guide plate 21 is moved together with the first movable member 6 in the vertical direction, but the guide plate 21 is relatively moved with respect to the first movable member 6 in the front-rear direction. Since the guide plate 21 is press-fitted in the guide hole 6*e*, a relatively great friction resistance is generated between an upper side surface of the guide plate 21 and an upper side portion of an inner circumferential surface of the guide groove 6*e*, and between a lower side surface of the guide plate 21 and a lower side portion of the inner circumferential surface of the guide hole 6*e*. Therefore, the guide plate 21 is not movable in the front-rear direction unless a force greater than the friction resistance is applied. Reversely, by applying a force overcoming the friction resistance on the guide plate 21, the guide plate 21 can be moved with respect to the first movable member 6 in the front-rear direction.

As show in FIG. 16, the first adjustment shaft 22 includes a first fitting portion 22*a* having a circular cross-section. The first fitting portion 22*a* is disposed with an axis thereof oriented in the left-right direction (vertical direction of FIGS. 15, 16, 21 and 22; third direction). An outer diameter of the first fitting portion 22*a* is generally the same as an inner diameter of a first fitting hole 21*a* formed in a front end portion of the guide plate 21. The first fitting portion 22*a* is fitted in the first fitting hole 21*a* such that the first fitting portion 22*a* is rotatable and relatively movable in the left-right direction. Moreover, the first fitting portion 22*a* is fitted in the first fitting hole 21*a* such that the first fitting portion 22*a* is relatively non-movable in the vertical direction and in the front-rear direction. Accordingly, the first adjustment shaft 22 is connected to the first movable member 6 such that the first adjustment shaft 22 is rotatable about the axis of the first fitting portion 22*a* (to be referred to as "first rotational axis" hereinafter) and movable in the front-rear direction (second direction) but non-movable in the vertical direction (first direction). Therefore, when the first fitting portion 22*a* of the first adjustment shaft 22 is moved in the vertical direction, the guide plate 21 and the first movable member 6 is moved in the vertical direction according to the movement of the first fitting portion 22*a*.

However, when the first fitting portion 22*a* is moved in the front-rear direction, only the guide plate 21 is moved in the front-rear direction with respect to the first movable member 6 and the first movable member 6 is not movable in the front-rear direction. Alternatively, the first fitting portion 22*a* may be fitted in the first fitting hole 21*a* such that the first fitting portion 22*a* is non-movable in the left-right direction.

A first eccentric shaft 22*b* is formed in one end surface (lower end surface in FIG. 15) of the first fitting portion 22*a* facing the base member 5. The first eccentric shaft 22*b* has a circular cross-section. An axis of the first eccentric shaft 22*b* is parallel to the axis of the first fitting portion 22*a* and is spaced from the first rotational axis in a radial direction of the first fitting portion 22*a*. In other words, the first eccentric shaft 22*b* is decentered with respect to the first fitting portion 22*a*.

A first adjustment recess (first adjustment engagement portion) 23 is formed in a left side surface (upper side surface in FIG. 15) of the support part 5*a* opposed to the top plate 6*b* of the first movable member 6. The first adjustment recess 23 extends in the front-rear direction. The first eccentric shaft 22*b* is rotatably disposed in the first adjustment recess 23. Moreover, the first eccentric shaft 22*b* is disposed in the first adjustment recess 23 such that the first eccentric shaft 22*b* is movable in the front-rear direction but non-movable in the vertical direction. Accordingly, when the first adjustment shaft 22 is rotated about the first rotational axis in normal and reverse directions, the first eccentric shaft 22*b* is moved in the first adjustment recess 23 in the front-rear direction, while moving the first fitting portion 22*a* in the vertical direction. As a result, the first movable member 6 is moved with respect to the base member 5 in the vertical direction via the guide plate 21. Therefore, a position of the first movable member 6 with respect to the base member 5 in the vertical direction can be adjusted by rotating the first adjustment shaft 22 in the normal and reverse directions. Since the second movable member 7 is connected to the first movable member 6 such that the second movable member 7 is non-movable in the vertical direction, when the position of the first movable member 6 is adjusted in the vertical direction, a position of the second movable member 7 is adjusted in the vertical direction together with the first movable member 6.

A first head 22*c* is formed in the other end surface of the first fitting portion 22*a*, i.e. in the end surface of the first fitting portion 22*a* opposed to the top plate 7*b* of the second movable member 7. The first head 22*c* has a circular cross-section. The first head 22*c* is formed with an axis thereof coinciding with the axis of the first fitting portion 22*a*. The first head 22*c* is fitted in a first connecting hole 24 formed in the top plate 7*b* of the second movable member 7 such that the first head 22*c* is non-movable in the vertical direction and in the front-rear direction. Accordingly, when the first adjustment shaft 22 is rotated in the normal and reverse directions, the second movable member 7 is moved in the vertical direction together with the first movable member 6. However, as mentioned above, the second movable member 7 is not moved together with the first movable member 6 in the front-rear direction. Instead, the second movable member 7 is moved with respect to the first movable member 6 in the front-rear direction together with the guide plate 21. The second movable member 7 is connected to the first movable member 6 such that the second movable member 7 is non-movable in the vertical direction, and the second movable member 7 is movable in the vertical direction together with the first movable member 6. Therefore, the first head 22*c* is not necessarily fitted in the first connecting hole 24 of the second movable member 7. A cross recess to be engaged by a distal end portion of a Phillips-head screw driver is formed in a left end surface of the first head 22*c*. Alternatively, a hexagonal recess to be engaged by a hexagonal wrench may be formed in the left end surface of the first head 22*c*.

As is clear from the fact that the first fitting portion 22*a* of the first adjustment shaft 22 is fitted in the first fitting hole 21*a* of the guide plate 21, the first head 22*c* is fitted in the first connecting hole 24 of the top plate 7*b* of the second movable member 7 and the first eccentric shaft 22*b* is disposed in the first adjustment recess 23 of the base member 5, the first adjustment shaft 22 passes through the top plate 6*b* of the first movable member 6 in the left-right direction. A second adjustment shaft 32 of a second position adjustment mechanism 30 to be described below similarly passes through the top plate 6*b* of the first movable member 6.

As shown in FIGS. 21 and 22, the second position adjustment mechanism 30 is provided between the base member 5 and the second movable member 7. The second position adjustment mechanism 30 is provided for adjusting a position of the second movable member 7 with respect to the base member 5 in the front-rear direction. The second position adjustment mechanism 30 includes the guide plate 21 and the second adjustment shaft 32.

A second fitting hole 21*b* is formed in a rear end portion of the guide plate 21. The second fitting hole 21*b* extends through the guide plate 21 in the left-right direction. The second adjustment shaft 32 has a same shape and same dimensions as the first adjustment shaft 22. Accordingly, the second adjustment shaft 32 includes a second fitting portion 32*a*, a second eccentric shaft 32*b* and a second head 32*c*, respectively corresponding to the first fitting portion 22*a*, the first eccentric shaft 22*b* and the first head 22*c* of the first adjustment shaft 22. A recess to be engaged by a Phillips-head screw driver or a hexagonal wrench is formed in a left end surface of the second head 32*c*.

The second fitting portion 32*a* of the second adjustment shaft 32 is disposed with an axis thereof (to be referred to as "second rotational axis" hereinafter) oriented in the left-right direction. The second fitting portion 32*a* is fitted in the second fitting hole 21*b* of the guide plate 21 such that the second fitting portion 32*a* is rotatable about the second rotational axis and movable in the left-right direction. Moreover, the second fitting portion 32*a* is fitted in the second fitting hole 21*b* such that the second fitting portion 32*a* is non-movable in the vertical direction and in the front-rear direction. Therefore, the second fitting portion 32*a* is movable together with the guide plate 21 in the vertical direction and in the front-rear direction. In other words, when the second fitting portion 32*a* is moved in the vertical direction and in the front-rear direction, the guide plate 21 is moved together with the second fitting portion 32*a* in the vertical direction and in the front-rear direction. Moreover, the first fitting portion 22*a* of the first adjustment shaft 22 is fitted in the first fitting hole 21*a* of the guide plate 21 such that the first fitting portion 22*a* is non-movable in the vertical direction and in the front-rear direction. Accordingly, the first adjustment shaft 22 and the second adjustment shaft 32 are connected to each other via the guide plate 21 such that the first adjustment shaft 22 and the second adjustment shaft 32 are not relatively movable in the vertical direction and the front-rear direction. Alternatively, the second fitting portion 32*a* may be fitted in the second fitting hole 21*b* such that the second fitting portion 32*a* is non-movable in the left-right direction.

A second adjustment recess (second adjustment engagement portion) 33 is formed in the side surface of the support part 5*a* in which the first adjustment recess 23 is formed. The second adjustment recess 33 is disposed posterior to the first adjustment recess 23 and extends in the vertical direction. The second eccentric shaft 32*b* of the second adjustment shaft 32 is disposed in the second adjustment recess 33 such that the second eccentric shaft 32*b* is rotatable and movable in the vertical direction. Moreover, the second eccentric shaft 32*b* is disposed in the second adjustment recess 33 such that the second eccentric shaft 32*b* is non-movable in the front-rear direction. Accordingly, when the second adjustment shaft 32 is rotated about the second rotational axis, the second eccentric shaft 32*b* is moved in the second adjustment recess 33 in the vertical direction, while moving the second fitting portion 32*a* in the front-rear direction.

A second connecting hole 34 is formed in the top plate 7*b* of the second movable member 7. The second connecting hole 34 is located posterior to the first connecting hole 24. The second head 32*c* is fitted in the second connecting hole 34 such that the second head 32*c* is rotatable and movable in the left-right direction. Moreover, the second head 32*c* is fitted in the second connecting hole 34 such that the second head 32*c* is non-movable in the vertical direction and in the front-rear direction. Accordingly, when the second fitting portion 32*a* is moved in the front-rear direction, the second movable member 7 is moved in the front-rear direction together with the second fitting portion 32*a*. Therefore, a position of the second movable member 7 with respect to the base member 5 and the first movable member 6 can be adjusted in the front-rear direction by rotating the second adjustment shaft 32 in the normal and reverse directions.

When the second movable member 7 is moved in the front-rear direction, the guide plate 21 is moved in the front-rear direction with respect to the first movable member 6. As a result, the first adjustment shaft 22 is moved in the front-rear direction with respect to the base member 5. The first eccentric shaft 22*b* of the first adjustment shaft 22 is fitted in the first adjustment recess 23 of the base member 5 such that the first eccentric shaft 22*b* is movable in the front-rear direction. Therefore, the movement of the second movable member 7 and the guide plate 21 in the front-rear direction is not disturbed by the base member 5 and the first adjustment shaft 22. Similarly, when the first movable member 6 is moved in the vertical direction, the guide plate 21 is moved in the vertical direction. As a result, the second adjustment shaft 32 is moved in the vertical direction with respect to the base member 5. However, the second eccentric shaft 32*b* of the second adjustment shaft 32 is disposed in the second adjustment recess 33 of the base member 5 such that the second eccentric shaft 32*b* is movable in the vertical direction. Therefore, the movement of the first movable member 6 in the vertical direction is not disturbed by the base member 5 and the second adjustment shaft 32.

Figure 23:
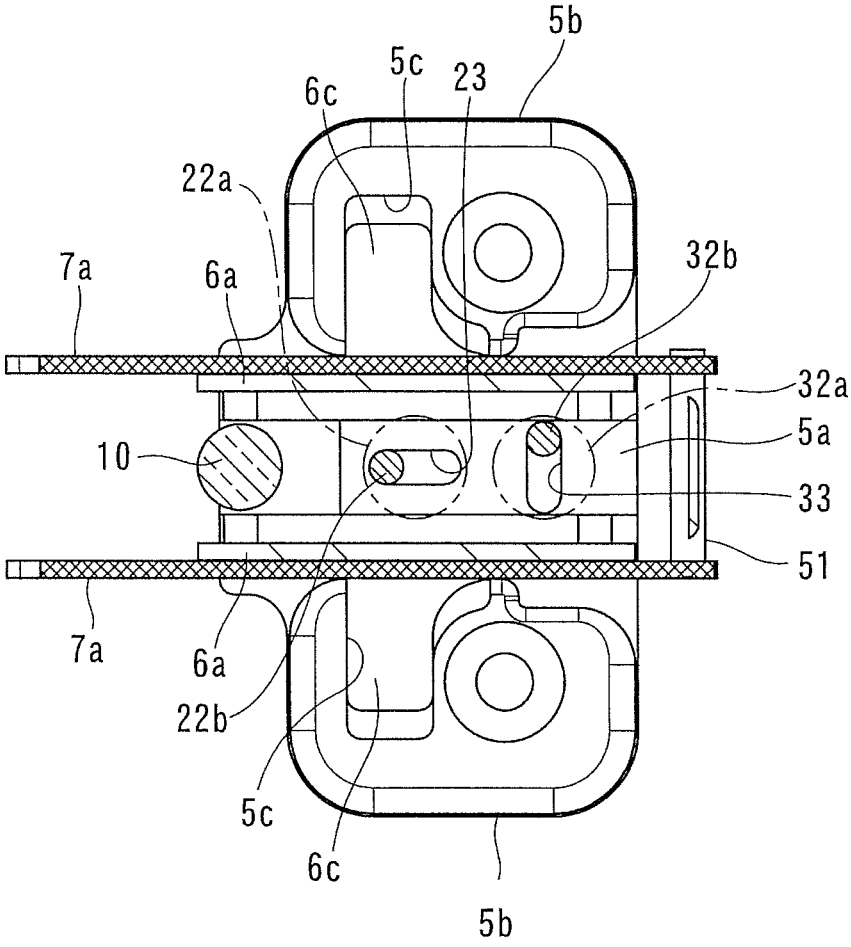
FIG. 23 is a cross-sectional view taken along line X-X of FIG. 21, showing the body in an intermediate position with respect to the base in a vertical direction and in a front-rear direction.

FIGS. 23 to 28 show a positional relationship between the first eccentric shaft 22*b* and the first adjustment recess 23 and a positional relationship between the second eccentric shaft 32*b* and the second adjustment recess 33. Let us assume that the first movable member 6 is at a central portion in an area for adjustment in the vertical direction and the second movable member 7 is at a central portion in an area for adjustment in the front-rear direction. In this condition, as shown in FIG. 23, the first eccentric shaft 22*b* is at a front end portion of the first adjustment recess 23 and the second eccentric shaft 32*b* is at an upper end portion of the second adjustment recess 33. Positions of the first movable member 6 and the second movable member 7 at this time are referred to as initial positions hereinafter.

Figure 24:
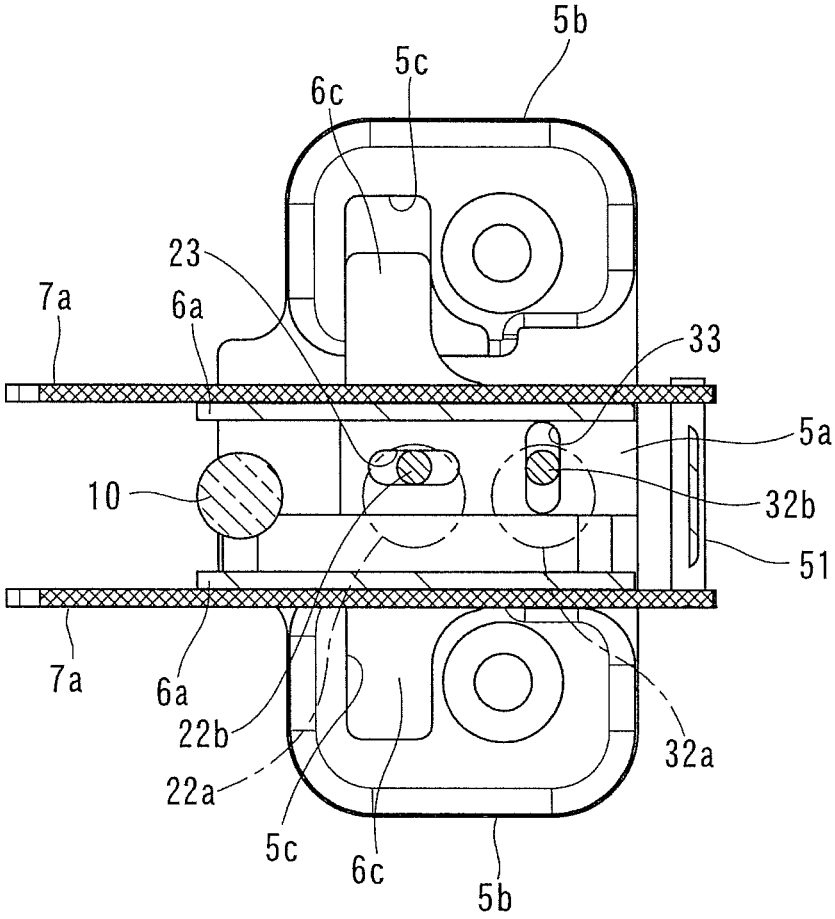
FIG. 24 is a cross-sectional view similar to FIG. 23, showing the body in a lower limit position with respect to the base in the vertical direction and in the intermediate position with respect to the base in the front-rear direction.

In a condition where the first movable member 6 and the second movable member 7 are respectively at the respective initial positions, when the first adjustment shaft 22 is rotated through 90 degrees in a clockwise direction, the first fitting portion 22*a* is moved to a lower limit position with respect to the first eccentric shaft 22*b* as shown in FIG. 24. As a result, the first movable member 6 is moved to a lower limit position. At this time, the first eccentric shaft 22*b* is moved rearward in the first adjustment recess 23 to a central portion of the first adjustment recess 23, and the second eccentric shaft 32*b* is moved in the second adjustment recess 33 to a central portion of the second adjustment recess 33 in the vertical direction.

Figure 25:
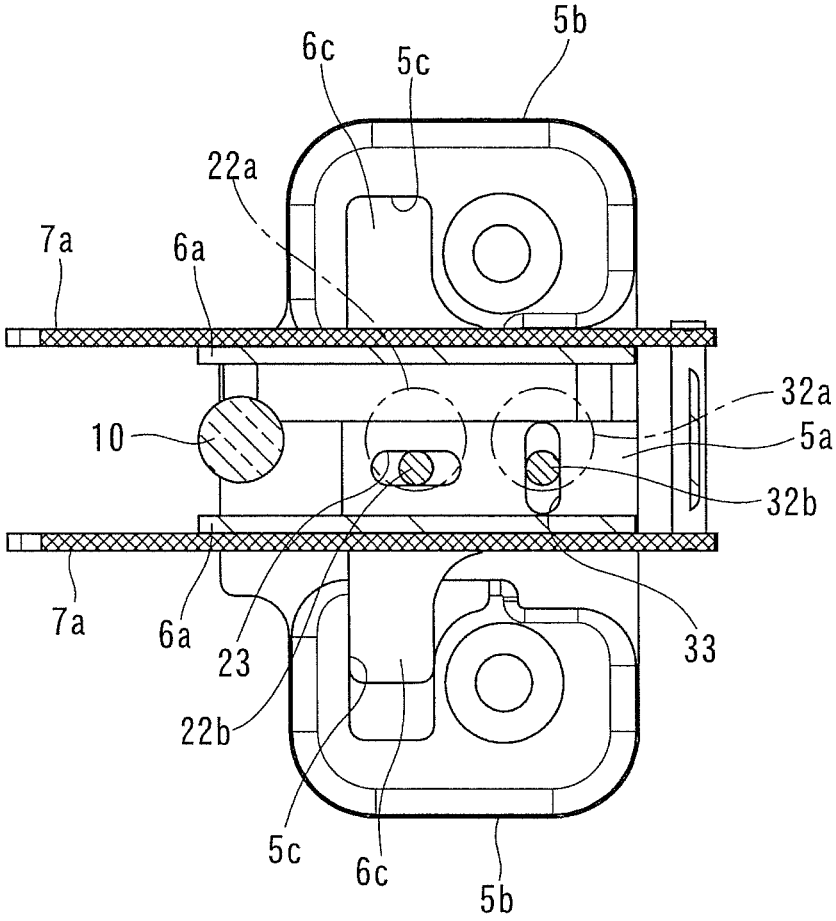
FIG. 25 is a cross-sectional view similar to FIG. 23, showing the body in an upper limit position with respect to the base in the vertical direction and in the intermediate position with respect to the base in the front-rear direction.

In a condition where the first movable member 6 and the second movable member 7 are at the respective initial positions, when the first adjustment shaft 22 is rotated through 90 degrees in a counter-clockwise direction, the first fitting portion 22*a* is moved to an upper limit position with respect to the first eccentric shaft 22*b* as shown in FIG. 25. As a result, the first movable member 6 is moved to an upper limit position. At this time, the first eccentric shaft 22*b* is moved rearward in the first adjustment recess 23 to the central portion of the first adjustment recess 23, and the second eccentric shaft 32*b* is moved in the second adjustment recess 33 to the central portion of the second adjustment recess 33 in the vertical direction.

Figure 26:
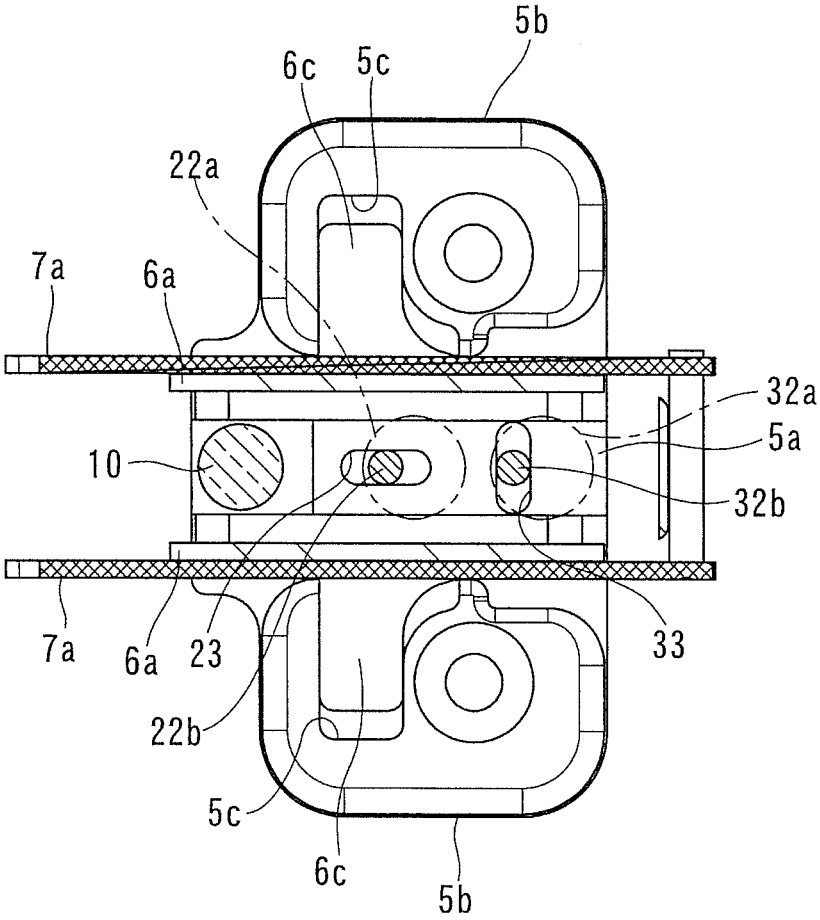
FIG. 26 is a cross-sectional view similar to FIG. 23, showing the body in the intermediate position with respect to the base in the vertical direction and in a rear limit position with respect to the base in the front-rear direction.

In a condition where the first movable member 6 and the second movable member 7 are at the respective initial positions, when the second adjustment shaft 32 is rotated through 90 degrees in the counter-clockwise direction, the second fitting portion 32*a* is moved to a rear limit position with respect to the second eccentric shaft 32*b* as shown in FIG. 26. As a result, the second movable member 7 is moved to a rear limit position. At this time, the first eccentric shaft 22*b* is moved rearward in the first adjustment recess 23 to the central portion of the first adjustment recess 23, and the second eccentric shaft 32*b* is moved downward in the second adjustment recess 33 to the central portion of the second adjustment recess 33.

Figure 27:
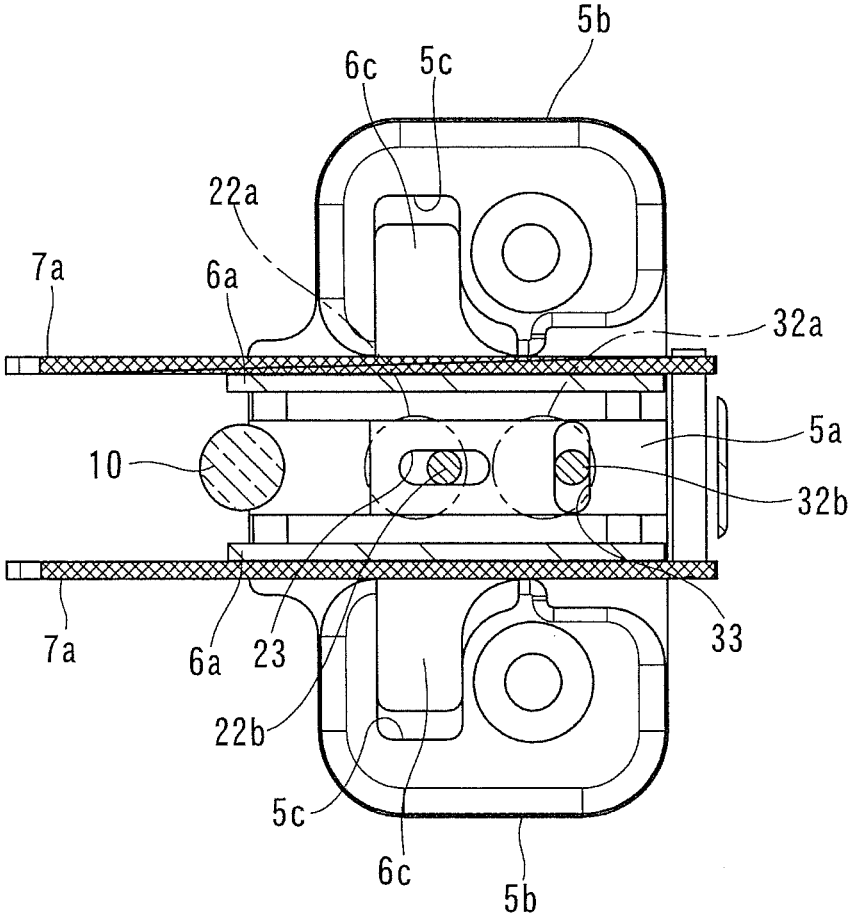
FIG. 27 is a cross-sectional view similar to FIG. 23, showing the body in the intermediate position with respect to the base in the vertical direction and in a front limit position with respect to the base in the front-rear direction.

In a condition where the first movable member 6 and the second movable member 7 are at the respective initial positions, when the second adjustment shaft 32 is rotated through 90 degrees in the clockwise direction, the second fitting portion 32*a* is moved to a front limit position with respect to the second eccentric shaft 32*b* as shown in FIG. 27. As a result, the second movable member 7 is moved to a front limit position. At this time, the first eccentric shaft 22*b* is moved rearward in the first adjustment recess 23 to the central portion of the first adjustment recess 23, and the second eccentric shaft 32*b* is moved downward in the second adjustment recess 33 to the central portion of the second adjustment recess 33.

Figure 28:
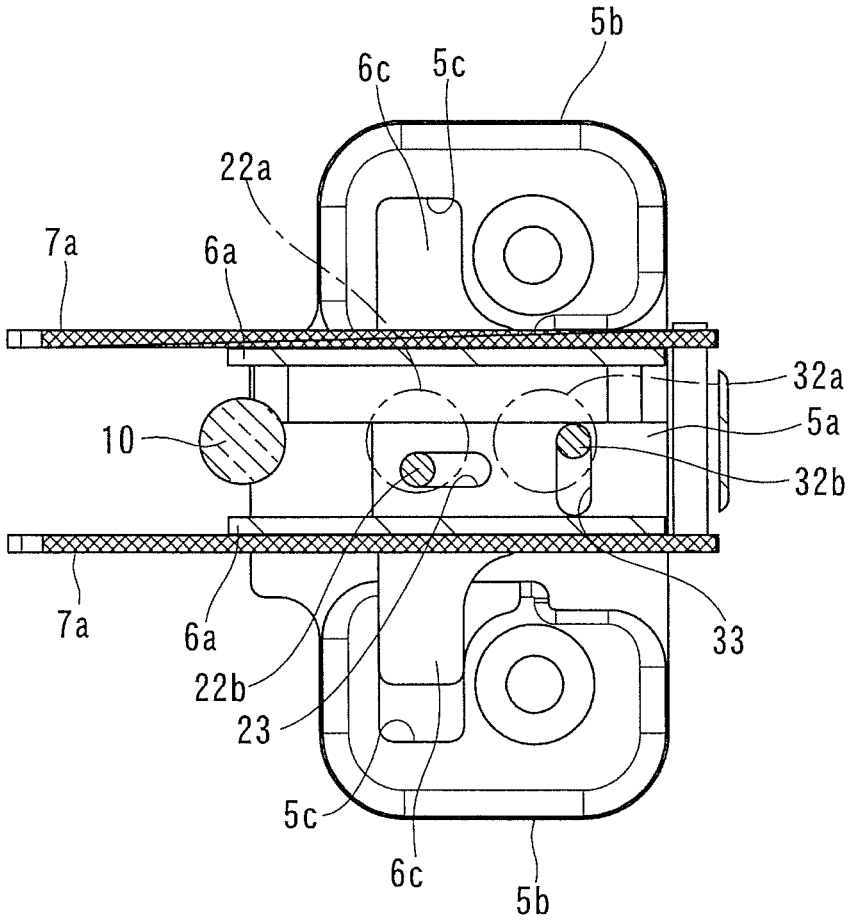
FIG. 28 is a cross-sectional view similar to FIG. 23, showing the body in the upper limit position with respect to the base in the vertical direction and in the front limit position with respect to the base in the front-rear direction.
Figure 29:
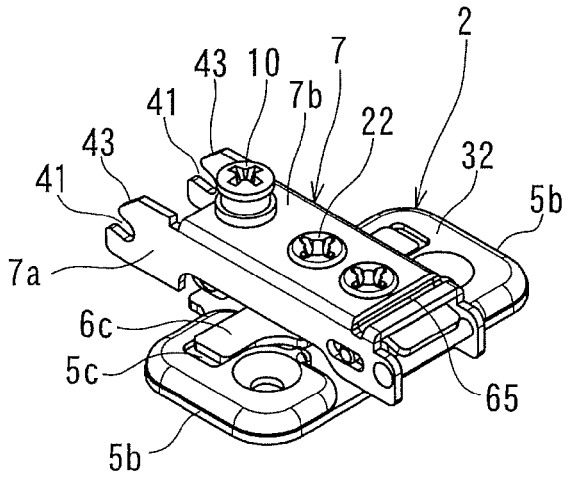
FIG. 29 is a perspective view of a second embodiment of the present invention, showing a body removed from a base.
Figure 29:
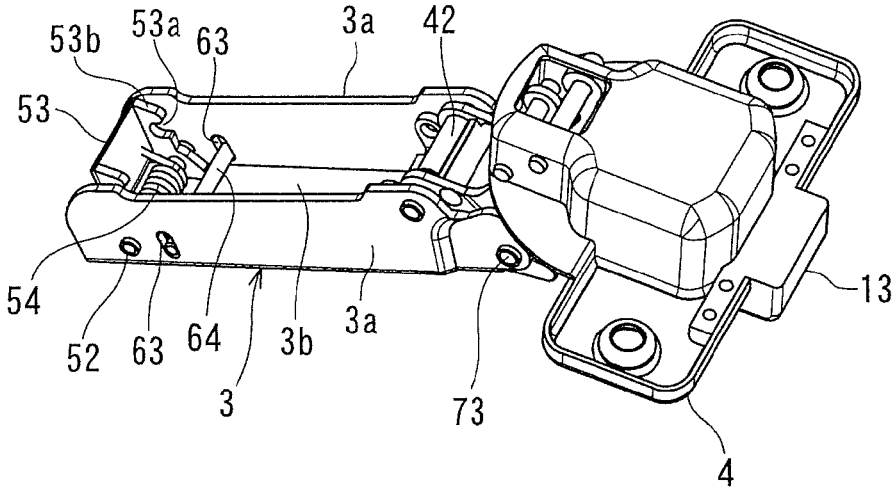
Figure 30:
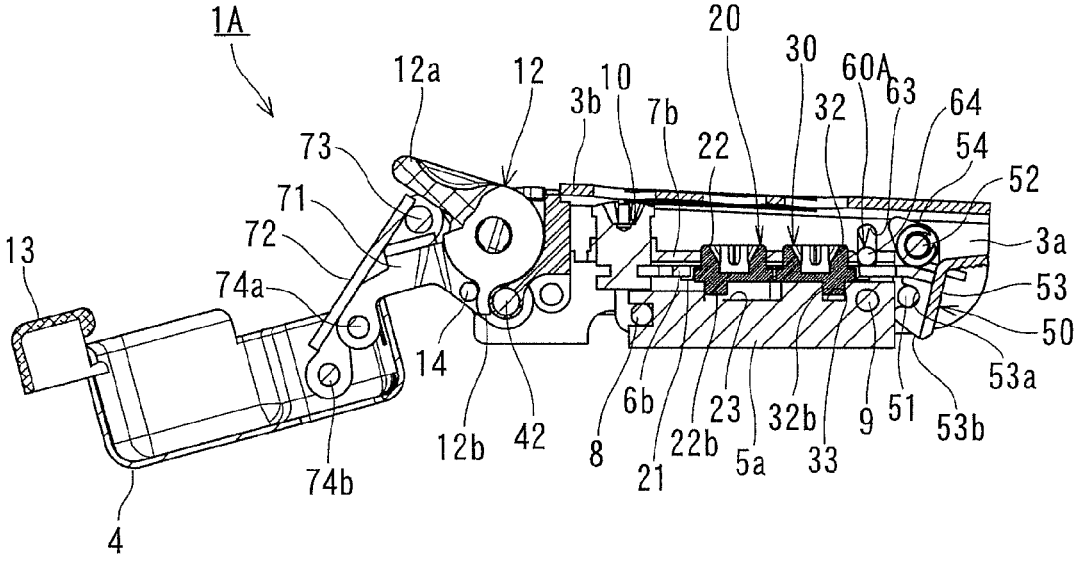
FIG. 30 is a cross-sectional view of the second embodiment, corresponding to FIG. 6.
Figure 31:
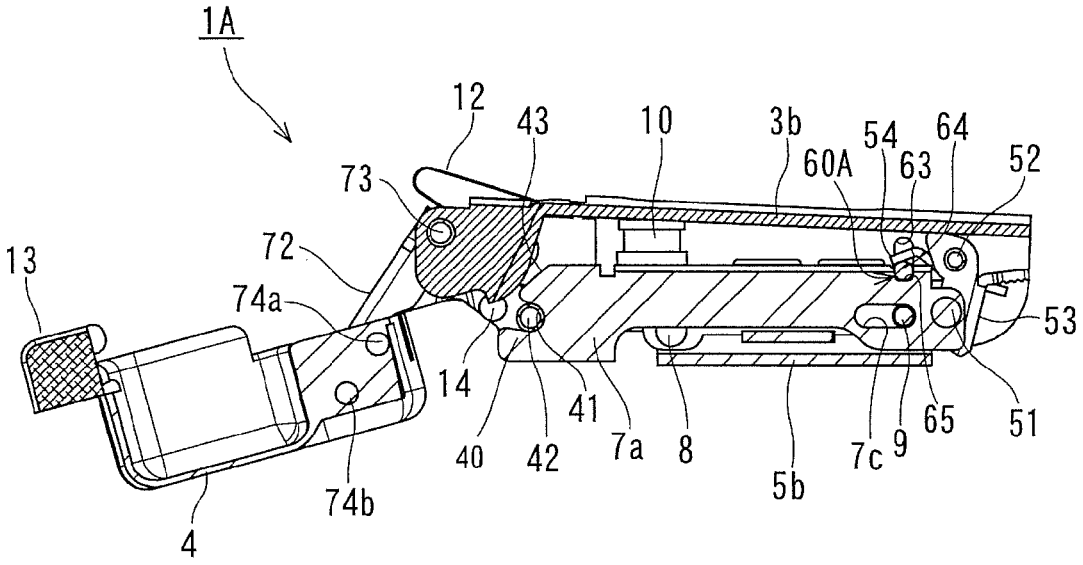
FIG. 31 is a cross-sectional view of the second embodiment, corresponding to FIG. 7.
Figure 32:
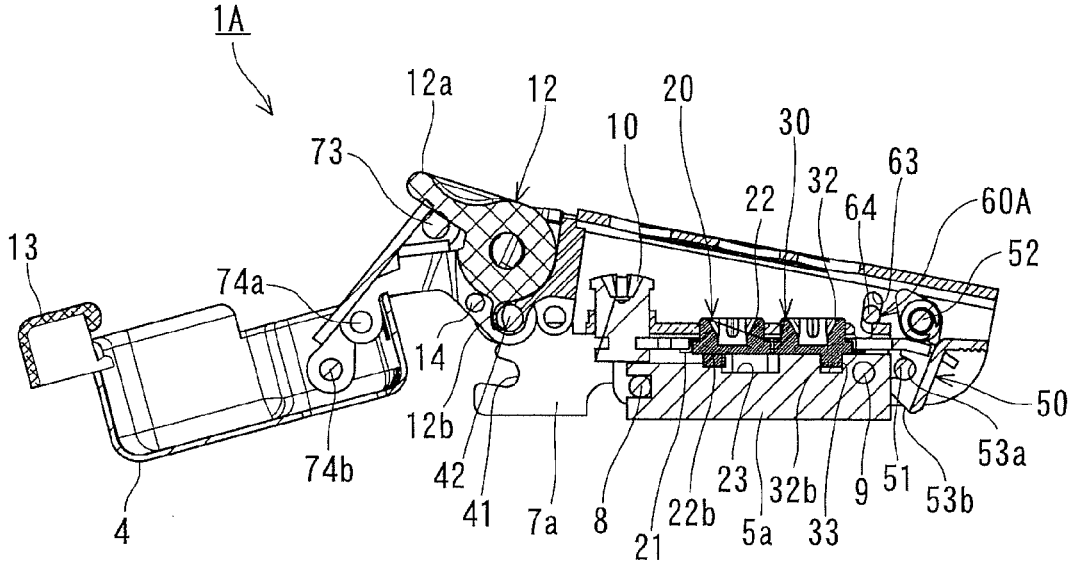
FIG. 32 is a cross-sectional view similar to FIG. 30, for explaining an example of a method for attaching the body of the second embodiment to the base of the second embodiment.
Figure 33:
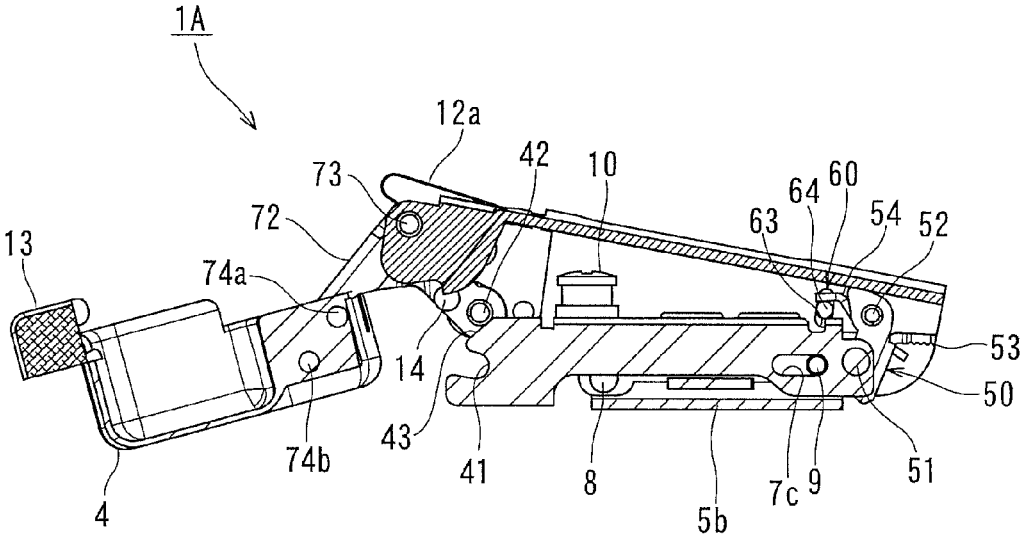
FIG. 33 is a cross-sectional view similar to FIG. 31, for explaining the example of the method for attaching the body of the second embodiment to the base of the second embodiment.

In a condition where the first movable member 6 and the second movable member 7 are at the respective initial positions, when the first adjustment shaft 22 is rotated through 90 degrees in the counter-clockwise direction and the second adjustment shaft 32 is rotated through 90 degrees in the clockwise direction, the first fitting portion 22*a* is moved to the upper limit position with respect to the first eccentric shaft 22*b* and the second fitting portion 32*a* is moved to the front limit position with respect to the second eccentric shaft 32*b* as shown in FIG. 28. As a result, the first movable member 6 is moved to the upper limit position and the second movable member 7 is moved to the front limit position. At this time, the first eccentric shaft 22*b* is at the front end portion of the first adjustment recess 23 and the second eccentric shaft 32*b* is at the upper end portion of the second adjustment recess 33.

As described above, the positions of the first movable member 6 and the second movable member 7 can be adjusted with respect to the base member 5 in the vertical direction by rotating the first adjustment shaft 22, and the position of the second movable member 7 can be adjusted with respect to the base member 5 and the first movable member 6 in the front-rear direction by rotating the second adjustment shaft 32. After the position adjustment, the respective positions of the first movable member 6 and the second movable member 7 are fixed by frictional resistance generated between the guide plate 21 and the guide hole 6*e*. When fixing mechanisms for respectively fixing the first movable member 6 and the second movable member 7 to the base member 5 are respectively provided between the base member 5 and the first movable member 6 and between the base member 5 and the second movable member 7, the guide plate 21 is not required.

The body 3 includes a pair of side plates 3*a*, 3*a* disposed so as to be opposed to each other and a top plate 3*b*. The top plate 3*b* is integrally disposed at one side portions of the pair of the side plates 3*a*, 3*a* and connects the one side portions of the side plates 3*a*, 3*a*. Accordingly, the body 3 has a generally U-shaped cross-section formed by the side plates 3*a*, 3*a* and the top plate 3*b*. The body 3 is disposed with a longitudinal direction of the body 3 oriented in the front-rear direction, a direction in which the side plates 3*a*, 3*a* are opposed oriented in the vertical direction and an open portion of the body 3 oriented to the right (toward the second movable member 7). The second movable member 7 is removably inserted into a space between the side plates 3*a*, 3*a* from the top plate 7*b* side. A distance between inner surfaces of the side plates 3*a*, 3*a* opposed to each other is generally the same as a distance between outer surfaces of the side plates 7*a*, 7*a* of the second movable member 7. Therefore, when the body 3 is moved rightward and the second movable member 7 is inserted between the side plates 3*a*, 3*a*, the body 3 is connected to the second movable member 7 such that the body 3 is non-movable in the vertical direction.

A front end portion (end portion in the front side) of the body 3 is removably attached to a front end portion of the second movable member 7 via a first engagement mechanism 40. A rear end portion of the body 3 is removably attached to a rear end portion of the second movable member 7 via a second engagement mechanism 50.

The first engagement mechanism 40 will be described first. As shown in FIG. 7 and FIGS. 9 to 15, first engagement recesses 41 that are open in front are respectively formed in front end surfaces of the side plates 7*a*, 7*a* of the second movable member 7. As shown in FIG. 7, FIGS. 9 to 14 and FIG. 17, opposite end portions of a first rotational shaft 42 are respectively attached to front end portions of the side plates 3*a*, 3*a* of the body 3. The opposite end portions of the first rotational shaft 42 are disposed on the base member 5 side of the front end portions of the side plates 3*a*, 3*a*. The first rotational shaft 42 has a longitudinal direction thereof oriented in the vertical direction. The first rotational shaft 42 can be inserted in the first engagement recess 41 from the open portion of the first engagement recess 41 up to a bottom portion of the first engagement recess 41 by moving the body 3 rearward, with the first rotational shaft 42 opposed to the open portion of the first engagement recess 41. In an engaged state in which the first rotational shaft 42 is inserted up to the bottom portion of the first engagement recess 41, the front end portion of the body 3 is caught by the front end portion of the second movable member 7 such that the front end portion of the body 3 is non-movable in the left-right direction and non-movable rearward. The front end portion of the body 3 is removably attached to the front end portion of the second movable member 7 in this manner.

Figure 12:
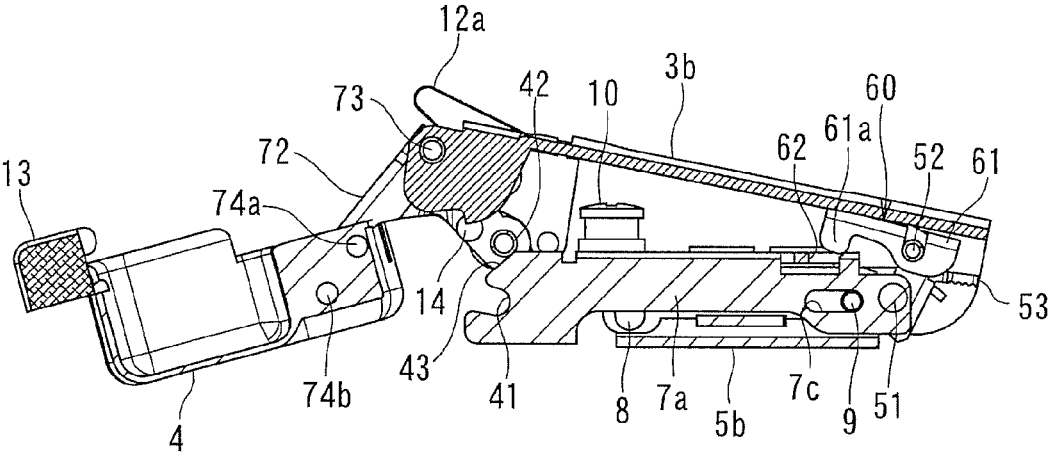
FIG. 12 is a view to explain an example of a method for attaching the body of the first embodiment to the base of the first embodiment, showing the hinge device in a state at a beginning of attaching process.
Figure 13:
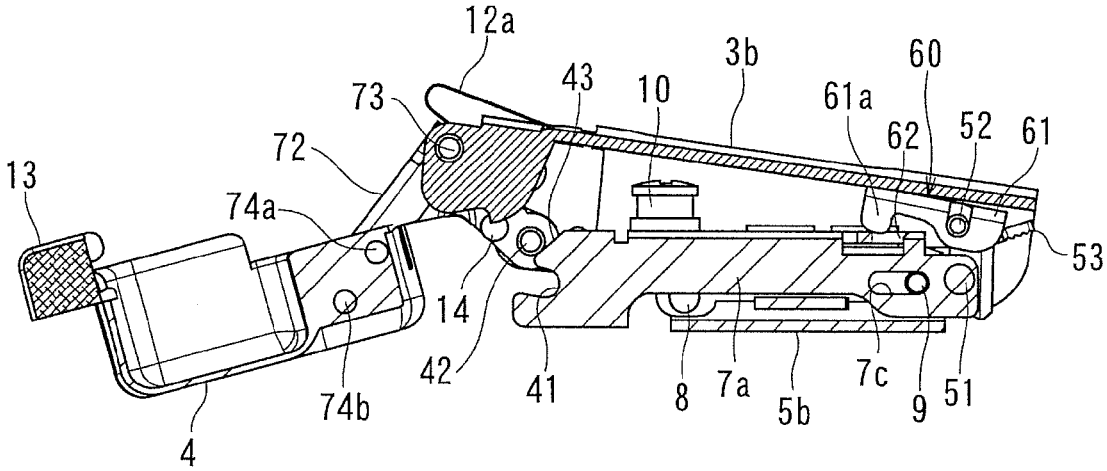
FIG. 13 is a view to explain the example of the method for attaching the body of the first embodiment to the base of the first embodiment, showing the hinge device in a state closer to completion of the attaching process than the state shown in FIG. 12.

The first rotational shaft 42 can be inserted into the first engagement recess 41 by being made to slide on an inclined surface 43 formed in the front end portion of the second movable member 7. Specifically, as shown in FIGS. 12 and 13, the inclined surface 43 is formed in a front end portion of the side plate 7*a* of the second movable member 7. The inclined surface 43 extends from an end portion of the side plate 7*a* on the top plate 7*b* side to the first engagement recess 41. The inclined surface 43 is inclined such that the front end of the inclined surface 43 is closer to the first engagement recess 41 than the rear end of the inclined surface 43. Therefore, when the body 3 is moved forward with the first rotational shaft 42 pressed against an end portion of the inclined surface 43 on the top plate 7*b* side, the first rotational shaft 42 is made to slide on the inclined surface 43 forward. After the first rotational shaft 42 is moved past the inclined surface 43, the first rotational shaft 42 reaches the open portion of the first engagement recess 41. After that, by moving the body 3 rearward, the first rotational shaft 42 can be inserted in the first engagement recess 41.

Figure 17:
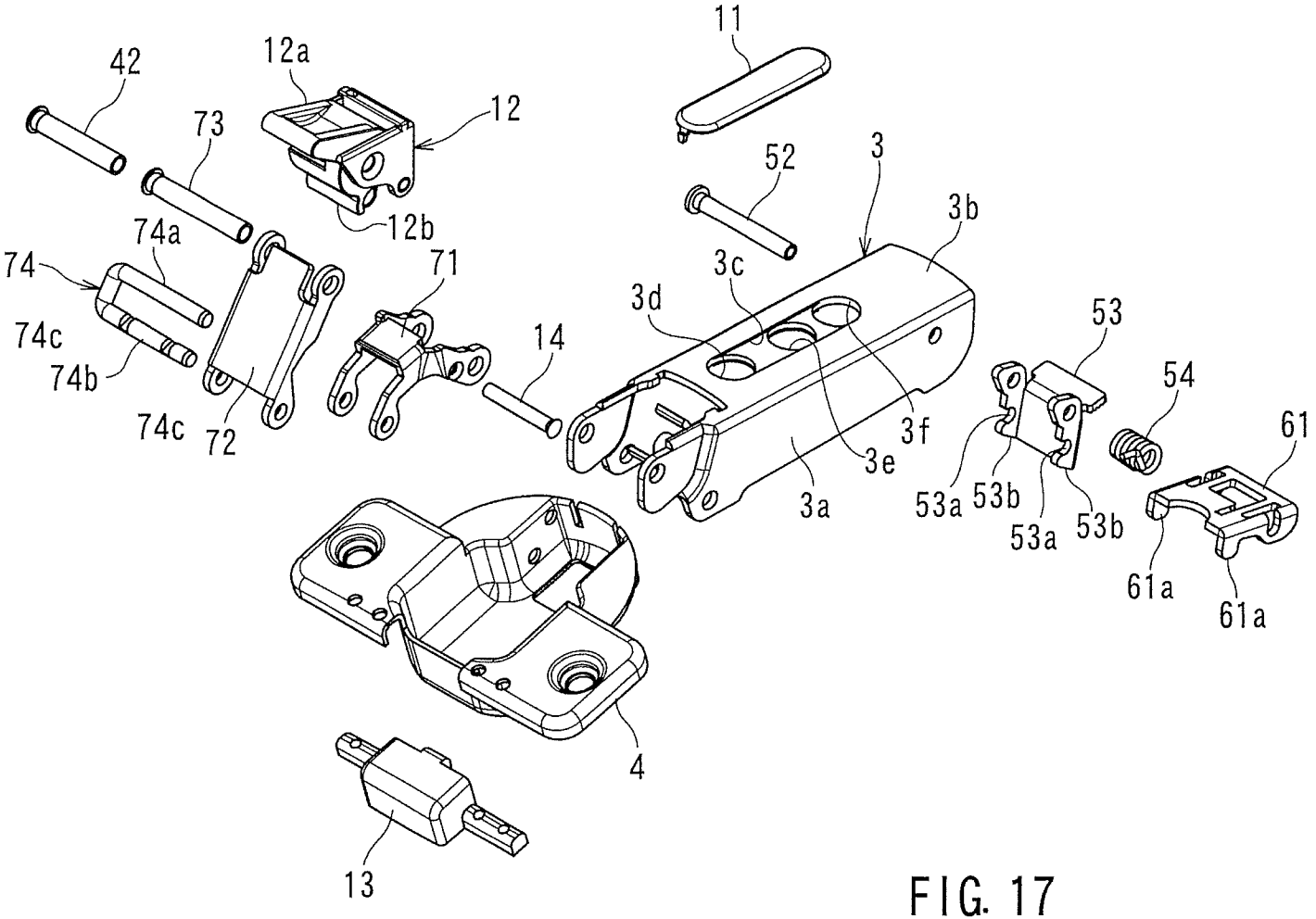
FIG. 17 is an exploded perspective view of the body, a first link, a second link and the mounting member according to the first embodiment.
Figure 18:
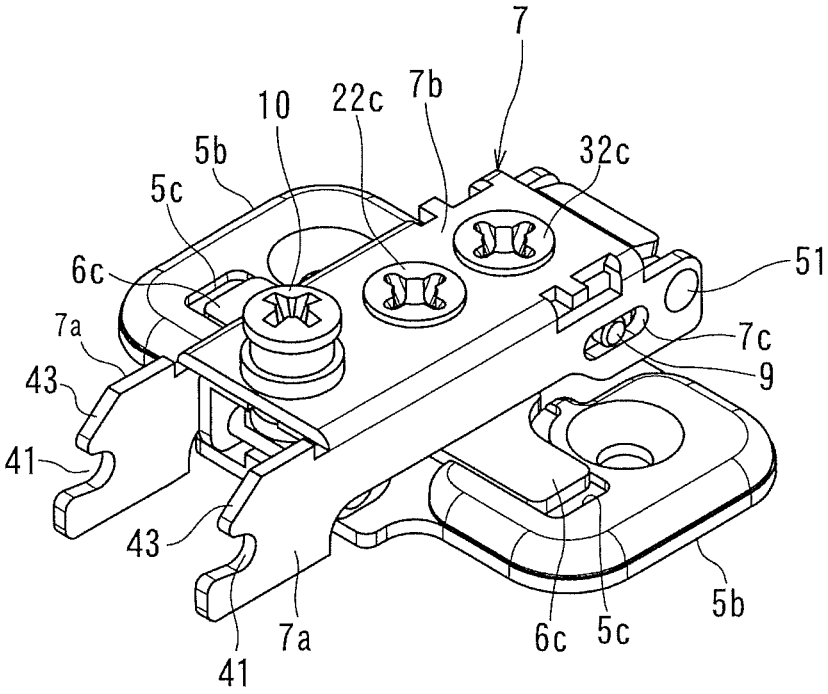
FIG. 18 is a perspective view of the base according to the first embodiment.
Figure 19:
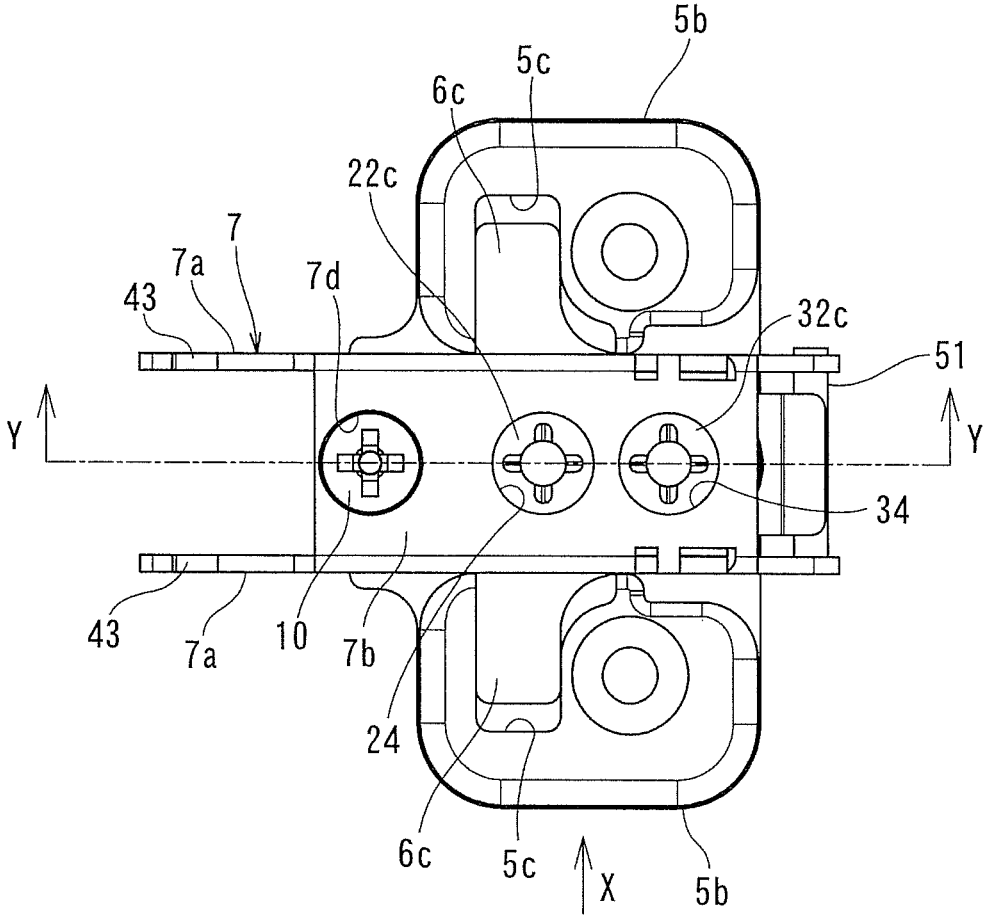
FIG. 19 is a plan view of the base.

The second engagement mechanism 50 will be described next. As shown in FIG. 15, an engagement shaft 51 is disposed in the rear end portions of the side plates 7*a*, 7*a* of the second movable member 7. The engagement shaft 51 is fixed in position with a longitudinal direction thereof oriented in the vertical direction. As shown in FIG. 17, a support shaft 52 is disposed in the side plates 3*a*, 3*a* of the body 3. The support shaft 52 is fixed in position with a longitudinal direction thereof oriented in the vertical direction. An operation member 53 is rotatably supported by the support shaft 52. The operation member 53 is rotatable between an engaged position shown in FIG. 3 and a released position spaced from the engaged position by a predetermined angle in a counter-clockwise direction of FIGS. 3 and 14 (position slightly spaced from the position shown in FIG. 14 in the counter-clockwise direction). The operation member 53 is biased from the released position toward the engaged position by a biasing force of a torsion coil spring 54 provided at the support shaft 52.

Figure 3:
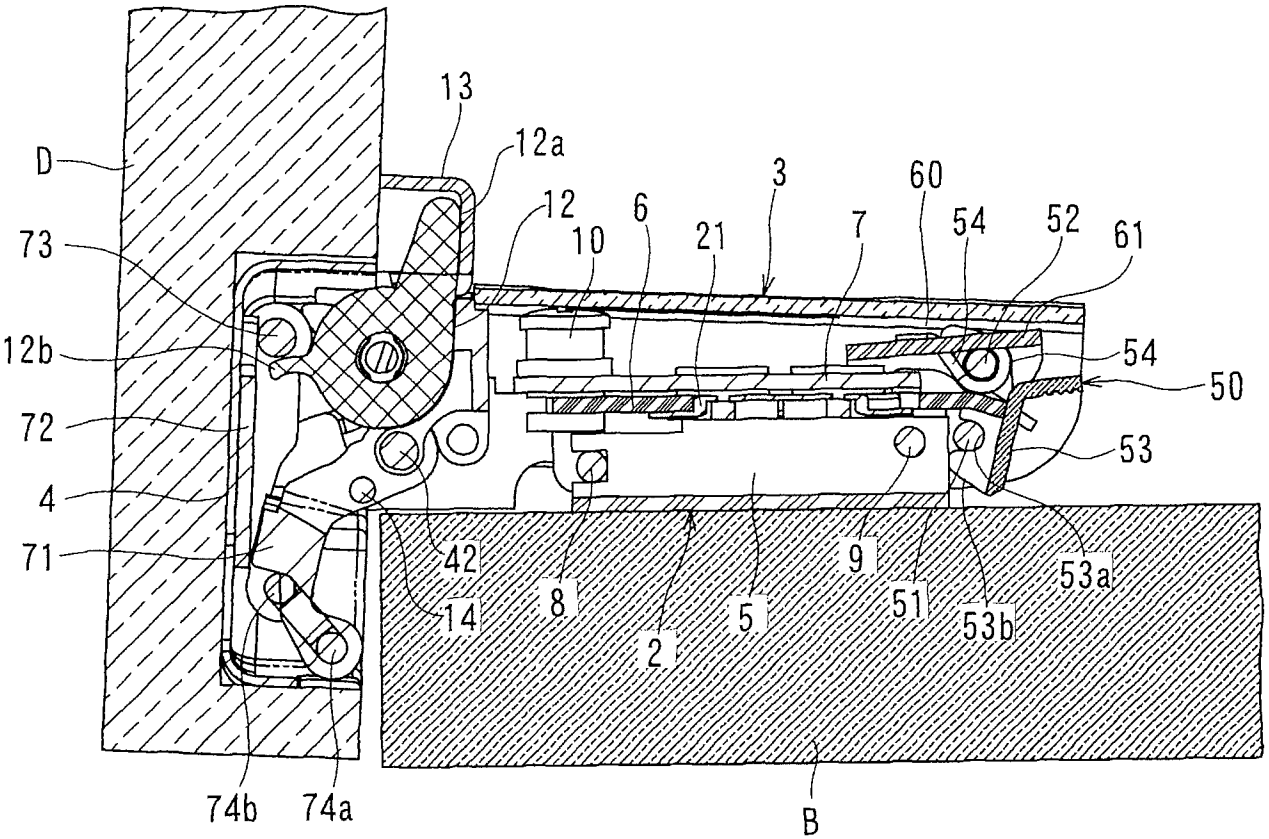
FIG. 3 is a cross-sectional view, taken along line X-X of FIG. 2.
Figure 4:
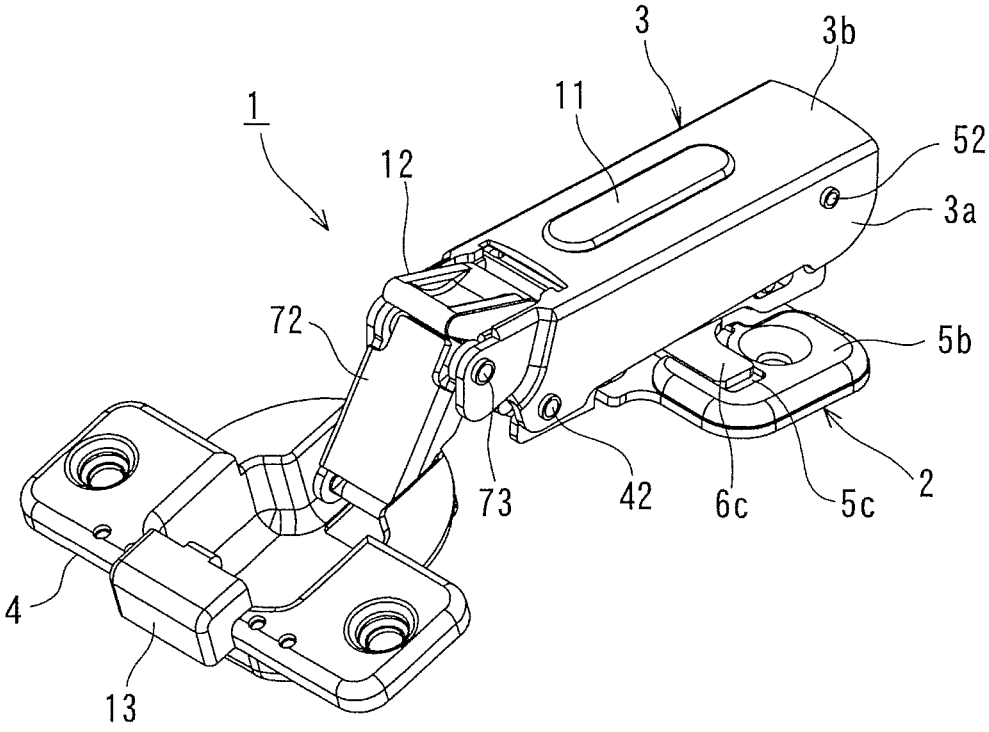
FIG. 4 is a perspective view of the first embodiment, showing a mounting member in an open position.
Figure 5:
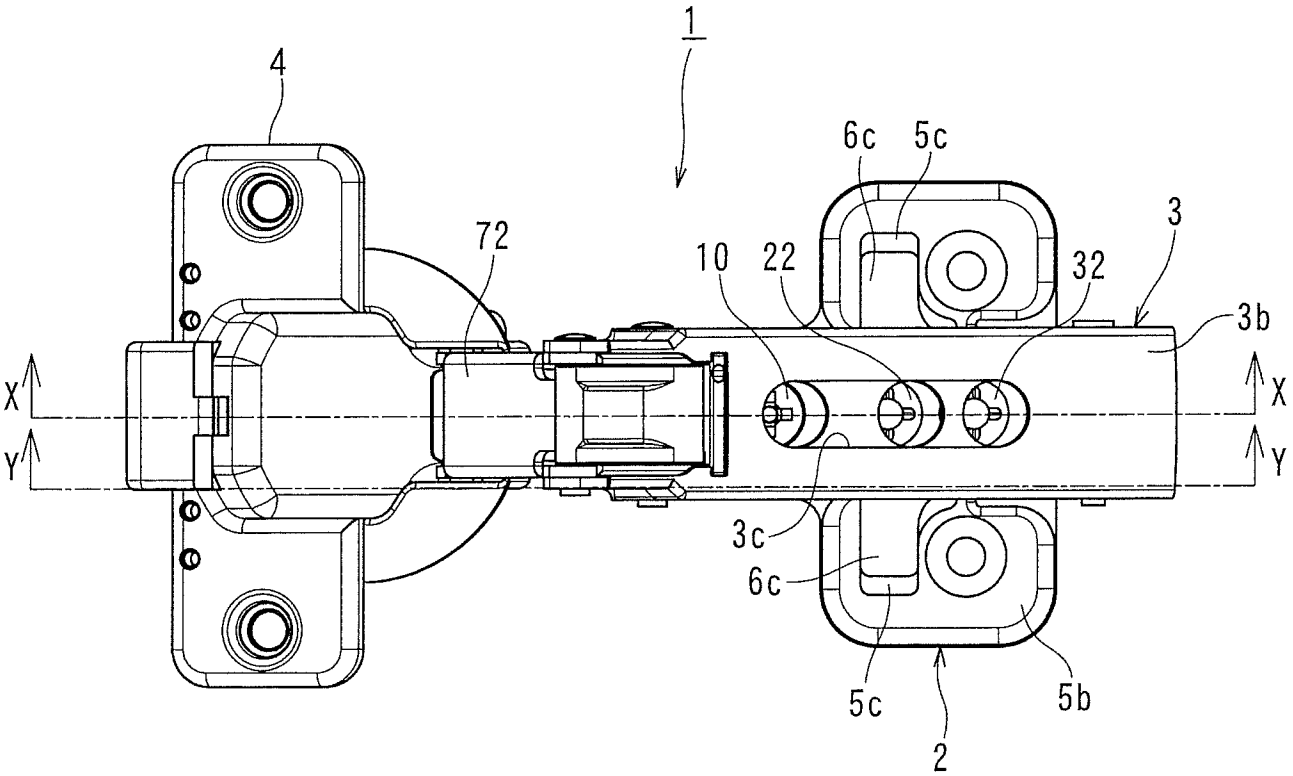
FIG. 5 is a side view of the first embodiment, showing the mounting member in the open position.

As shown in FIGS. 3 and 17, a second engagement recess 53*a* is formed in a surface of the operation member 53 facing forward. The second engagement recess 53*a* is open toward the front. When the operation member 53 is rotated from the released position up to the engaged position, the engagement shaft 51 relatively enters the second engagement recess 53*a* from the open portion of the second engagement recess 53*a* until the engagement shaft 51 is abutted against a bottom portion of the second engagement recess 53*a*. The position of the operation member 53 when the engagement shaft 51 is abutted against the bottom portion of the second engagement recess 53*a* is the engaged position. When the operation member 53 is in the engaged position, the movement of the body 3 in the left-right direction is prohibited by the engagement of the engagement shaft 51 with the second engagement recess 53*a*, and the movement of the body 3 rearward is prohibited by the biasing force of the torsion coil spring 54. The rear end portion of the body 3 is removably attached to the rear end portion of the second movable member 7 in this manner. When the operation member 53 is rotated form the engaged position to the released position against the biasing force of the torsion coil spring 54, the engagement shaft 51 comes out of the second engagement recess 53*a*, thereby enabling the rear end portion of the body 3 to be disengaged from the rear end portion of the second movable member 7.

Figure 14:
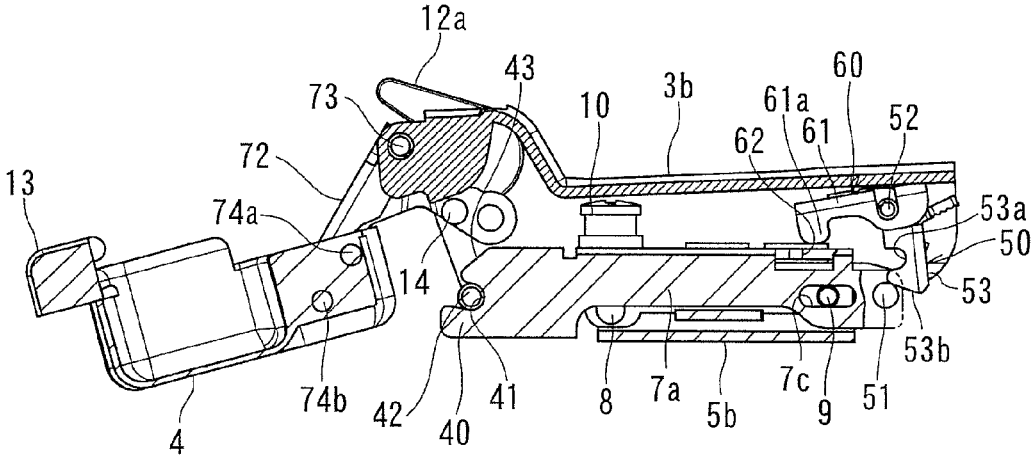
FIG. 14 is a view to explain another example of the method for attaching the body of the first embodiment to the base of the first embodiment.

As shown in FIGS. 3 and 14, an inclined surface 53*b* is formed in the operation member 53. The inclined surface 53*b* is formed continuously from the second engagement recess 53*a* to the right of the second engagement recess 53*a* (below the second engagement recess 53*a* in FIG. 14). The inclined surface 53*b* is inclined such that a rear end of the inclined surface 53*b* is positioned more rightward than a front end of the inclined surface 53*b*. Moreover, as shown in FIG. 14, the inclined surface 53*b* is disposed such that when the body 3 is rotated about the first rotational shaft 42 engaged with the first engagement recess 41 in a clockwise direction to bring the rear end portion of the body 3 closer to the engagement shaft 51, the inclined surface 53*b* is abutted against the engagement shaft 51. In a condition where the inclined surface 53*b* is abutted against the engagement shaft 51, when the body 3 is rotated further in the clockwise direction, the operation member 53 is rotated from the engaged position toward the released position against the biasing force of the torsion coil spring 54 by the engagement shaft 51 and the inclined surface 53*b*. When the operation member 53 is rotated, the engagement shaft 51 is relatively moved forward on the inclined surface 53*b* according to the rotation of the operation member 53. When the engagement shaft 51 is moved over the inclined surface 53*b* (the released position of the operation member 53 is slightly spaced from the position of the operation member 53 at this time in the counter-clockwise direction), the operation member 53 is rotated up to the engaged portion by the torsion coil spring 54. As a result, the engagement shaft 51 is inserted into the second engagement recess 53*a* from the open portion of the second engagement recess 53*a* until the engagement shaft 51 is abutted against the bottom portion of the second engagement recess 53*a*.

The body 3 can be attached to the second movable member 7 in any of the following three methods.

In a first method of attachment, as shown in FIG. 14, the first rotational shaft 42 is inserted in the first engagement recess 41 first. In this condition, the body 3 is rotated about the first rotational shaft 42 in the clockwise direction to bring the rear end portion of the body 3 closer to the rear end portion of the second movable member 7. Then, as mentioned above, the inclined surface 53*b* is abutted against the engagement shaft 51. After that, when the body 3 is rotated further in the clockwise direction, the operation member 53 is rotated in a direction from the engaged position toward the released position (counter-clockwise direction of FIG. 14) against the biasing force of the torsion coil spring 54. When the engagement shaft 51 is moved over the inclined surface 53*b*, the operation member 53 is rotated toward the engaged position by the torsion coil spring 54, and the engagement shaft 51 enters the second engagement recess 53*a* and the engagement shaft 51 is engaged with the second engagement recess 53*a*. In this condition, the body 3 is prohibited from being moved in the left-right direction by the engagement of the first rotational shaft 42 with the first engagement recess 41 and the engagement of the engagement shaft 51 with the second engagement recess 53*a*. Moreover, the body 3 is prohibited from being moved in the front-rear direction by the first rotational shaft 42 being pressed against the bottom surface of the first engagement recess 41 and the engagement shaft 51 being pressed against the bottom surface of the second engagement recess 53*a* by the biasing force of the torsion coil spring 54. The body 3 is prohibited from being moved in the vertical direction by the side plates 7*a*, 7*a* of the second movable member 7. In this manner, the body 3 is removably attached to the second movable member 7 such that the body 3 is non-movable.

In a second method of attachment, in reverse to the first method, the engagement shaft 51 is preliminarily engaged with the second engagement recess 53*a*. In this condition, the body 3 is rotated about the engagement shaft 51 to bring the front end portion of the body 3 closer to the front end portion of the second movable member 7. Then, as shown in FIG. 12, the first rotational shaft 42 is abutted against the inclined surface 43. When the front end portion of the body 3 is brought further closer to the front end portion of the second movable member 7, the engagement shaft 51 slides forward on the inclined surface 43 as shown in FIG. 13. At this time, the body 3 is moved forward accompanying the movement of the engagement shaft 51 forward. As a result, the operation member 53 is pushed rearward by the engagement shaft 51 by a distance corresponding to the movement of the body 3, and the operation member 53 is rotated from the engaged position side toward the released position. After that, when the first rotational shaft 42 is moved over the inclined surface 43, it becomes possible for the first rotational shaft 42 to enter the first engagement recess 41. Then, the operation member 53 is rotated up to the engaged position by the torsion coil spring 54, and the body 3 is moved rearward according to the rotation of the operation member 53. The first rotational shaft 42 is inserted in the first engagement recess 41 until the first rotational shaft 42 is abutted against the bottom portion of the first engagement recess 41 by the movement of the body 3 rearward. The body 3 is removably attached to the second movable member 7 in this manner.

In a third method of attachment, the first rotational shaft 42 and the engagement shaft 51 are respectively made to contact the inclined surfaces 43, 53*b* at the same time. In this condition, when the body 3 is moved closer to the second movable member 7, the first rotational shaft 42 is moved forward on the inclined surface 43 and the engagement shaft 51 is moved rearward on the inclined surface 53*b*. At this time, the operation member 53 is rotated from the engaged position toward the released position by the engagement shaft 51 accompanying the movement of the body 3 closer to the second movable member 7. When the first rotational shaft 42 and the engagement shaft 51 are respectively moved over the inclined surfaces 43, 53*b*, the operation member 53 is rotated from the released position toward the engaged position by the torsion coil spring 54, and the engagement shaft 51 enters the second engagement recess 53*a*. When the engagement shaft 51 is abutted against the bottom portion of the second engagement recess 53*a*, the body 3 is moved rearward by the torsion coil spring 54, and the first rotational shaft 42 is inserted into the first engagement recess 41. The body 3 is removably attached to the second movable member 7 in this manner.

As shown in FIG. 17, a recess 3*c* extending in the front-rear direction is formed in a generally central portion of the top plate 3*b* of the body 3. First, second and third through holes 3*d*, 3*e*, 3*f* are formed in a bottom of the recess 3*c*. The first, second and third through holes 3*d*, 3*e*, 3*f* are provided so that tools such as a screw driver for adjusting by rotating the adjustment screw 10, the first adjustment shaft 22 and the second adjustment shaft 32 can be respectively inserted through the first, second and third through holes 3*d*, 3*e*, 3*f*. The first, second and third through holes 3*d*, 3*e*, 3*f* are arranged such that the first, second and third through holes 3*d*, 3*e*, 3*f* are respectively opposed to the adjustment screw 10, the first adjustment shaft 22 and the second adjustment shaft 32 in the respective axial directions of the adjustment screw 10, the first adjustment shaft 22 and the second adjustment shaft 32. A cover plate 11 is removably fitted in the recess 3*c*. By this arrangement, the first, second and third through holes 3*d*, 3*e*, 3*f*, the adjustment screw 10, the first adjustment shaft 22 and the second adjustment shaft 32 are kept from being seen from outside.

A third engagement mechanism 60 is provided between the rear end portion of the body 3 and the rear end portion of the second movable member 7. The third engagement mechanism 60 prevents the body 3 from coming away from the second movable member 7. Specifically, as mentioned above, the body 3 is prohibited from being moved forward with respect to the second movable member 7 by the biasing force of the torsion coil spring 54. Without the third engagement mechanism 60, if the body 3 is pushed forward with a force greater than the biasing force of the torsion coil spring 54, the body 3 would be moved forward, and the first rotational shaft 42 would come out of the first engagement recess 41. As a result, the body 3 might come away from the second movable member 7 in the right direction. The third engagement mechanism 60 is provided to surely prevent such an event.

The third engagement mechanism 60 includes a lock member 61. The lock member 61 is rotatably attached to the rear end portion of the body 3 via the support shaft 52. The lock member 61 is rotatable between an unlocked position shown in FIG. 12 and a locked position shown in FIG. 9. The lock member 61 is rotationally biased by the torsion coil spring 54 in a direction from the unlocked position toward the locked position. The lock member 61 may be rotationally biased in the direction from the unlocked position toward the locked position by another coil spring other than the torsion coil spring 54. The lock member 61 may be rotatably attached to the rear end portion of the body 3 via another shaft other than the support shaft 52.

Projections 61*a*, 61*a* projecting toward the second movable member 7 are respectively formed in upper and lower end portions of a distal end portion of the lock member 61. Lock grooves 62, 62 are formed in upper and lower end portions of the top plate 7*b* of the second movable member 7. The lock groove 62 is dimensioned such that the projection 61*a* can enter and leave the lock groove 62 in the left-right direction. A dimension of the lock groove 62 in the front-rear direction is generally the same as a dimension of the projection 61*a* in the front-rear direction. Moreover, the lock groove 62 is disposed such that the projection 61*a* can enter and leave the lock groove 62 only when the body 3 is attached to the second movable member 7 in a normal position. In other words, the projection 61*a* is disposed such that the projection 61*a* cannot enter the lock groove 62 until after the body 3 is attached to the second movable member 7 regardless of which of the three methods described above is used to attach the body 3 to the second movable member 7.

When the body 3 is attached to the second movable member 7 by one of the first to the third methods described above, at an initial stage of attaching, the projection 61*a* is abutted against the top plate 7*b* of the second movable member 7. Accordingly, when the body 3 is moved closer to the second movable member 7, the projection 61*a* is rotated toward the unlocked position according to the movement of the body 3. After that, when the body 3 is attached to the second movable member 7, that is when the first rotational shaft 42 of the first engagement mechanism 40 is inserted into the first engagement recess 41 until the first rotational shaft 42 is abutted against the bottom portion of the first engagement recess 41 and the engagement shaft 51 of the second engagement mechanism 50 is inserted into the second engagement recess 53*a* until the engagement shaft 51 is abutted against the bottom portion of the second engagement recess 53*a*, the projection 61*a* is rotated from the unlocked position to the locked position by the torsion coil spring 54, and the projection 61*a* enters the lock groove 62. Then, since the dimensions of the projection 61*a* and the lock groove 62 in the front-rear direction are the same, the body 3 is caught such that the body 3 is non-movable with respect to the second movable member 7 in the front-rear direction. Therefore, the body 3 can be surely prevented from being moved forward and coming away from the second movable member 7.

The body 3 is non-movably connected to the second movable member 7 by the first engagement mechanism 40, the second engagement mechanism 50 and the third engagement mechanism 60 all being in the engaged state. Accordingly, the position of the body 3 in the vertical direction and in the front-rear direction can be adjusted by adjusting the position of the second movable member 7 in the vertical direction and in the front-rear direction by the first position adjustment mechanism 20 and the second position adjustment mechanism 30.

Regardless of which of the first to the third methods is used to attach the body 3 to the second movable member 7, the body 3 can be removed from the second movable member 7 by rotating the operation member 53 from the engaged position to the released position. When the operation member 53 is rotated to the released position, the engagement shaft 51 comes out of the second engagement recess 53*a*. Then, the rear end portion of the body 3 is moved leftward to be spaced from the second movable member 7 until the operation member 53 is spaced leftward from the engagement shaft 51 and the projection 61*a* comes out of the lock groove 62. In other words, the body 3 is rotated about the first rotational shaft 42 in the counter-clockwise direction of FIG. 14. Then, the body 3 is moved forward, thereby causing the first rotational shaft 42 to come out of the first engagement recess 41. After that, the body 3 can be removed from the second movable member 7 by moving the body 3 leftward.

One end portion of the internal link 71 is rotatably connected to the front end portion of the body 3 via the first rotational shaft 42. One end portion of the external link 72 is also rotatably connected to the front end portion of the body 3 via a second rotational shaft 73 disposed parallel to the first rotational shaft 42. The second rotational shaft 73 is disposed anterior to and to the left of the first rotational shaft 42. The second rotational shaft 73 may be disposed at a same location as or posterior to the first rotational shaft 42 in the front-rear direction.

As is clear from the fact that the first rotational shaft 42 is used as a rotational shaft for the internal link 71 and as an engagement shaft of the first engagement mechanism 40, one shaft member is used both as the first rotational shaft 42 and as an engagement member in this embodiment. Different members, instead of the same member, may be used as the first rotational shaft 42 for the internal link 71 and as the engagement member of the first engagement mechanism 40.

As shown in FIG. 17, the mounting member 4 is provided with a connecting shaft unit 74. The connecting shaft unit 74 includes two shaft portions 74*a*, 74*b* extending parallel to the first and second rotational shafts 42, 73. The other end portion of the internal link 71 and the other end portion of the external link 72 are rotatably connected to the mounting member 4 respectively via the shaft portions 74*a*, 74*b*. As a result, the mounting member 4 is rotatably connected to the front end portion of the body 3 via the internal link 71 and the external link 72, and consequently, the door D is rotatably supported by the frame B via the hinge device 1. Therefore, when the position of the body 3 is adjusted in the vertical direction and in the front-rear direction, position of the door D with respect to the frame B can be adjusted in the vertical direction and in the front-rear direction. A pair of relief recesses 74*c*, 74*c* are formed in the shaft portion 74*b*. The recesses 74*c*, 74*c* are disposed such that the internal link 71 can enter the recesses 74*c*, 74*c* when the door D is in the closed position so that the door D can be surely rotated to the closed position. Alternatively, the shaft portions 74*a*, 74*b* may be formed as separate shafts.

The mounting member 4 is rotatable between a closed position shown in FIGS. 1 to 3 and FIGS. 8 and 9 and an open position shown in FIGS. 4 to 7. In FIG. 3, the door D is shown slightly inclined such that a free end of the door D is closer to the frame B than a supported side of the door D when the mounting member 4 is in the closed position. However, in reality, the door D is never rotated up to the position shown in FIG. 3. Instead, the door D can be rotated only up to a position in which the door D is parallel to the front surface of the frame B due to the abutment of the free end of the door D against the front surface of the frame B. At this time, the mounting member 4 is at a position slightly away from the closed position toward the open position.

Figure 6:
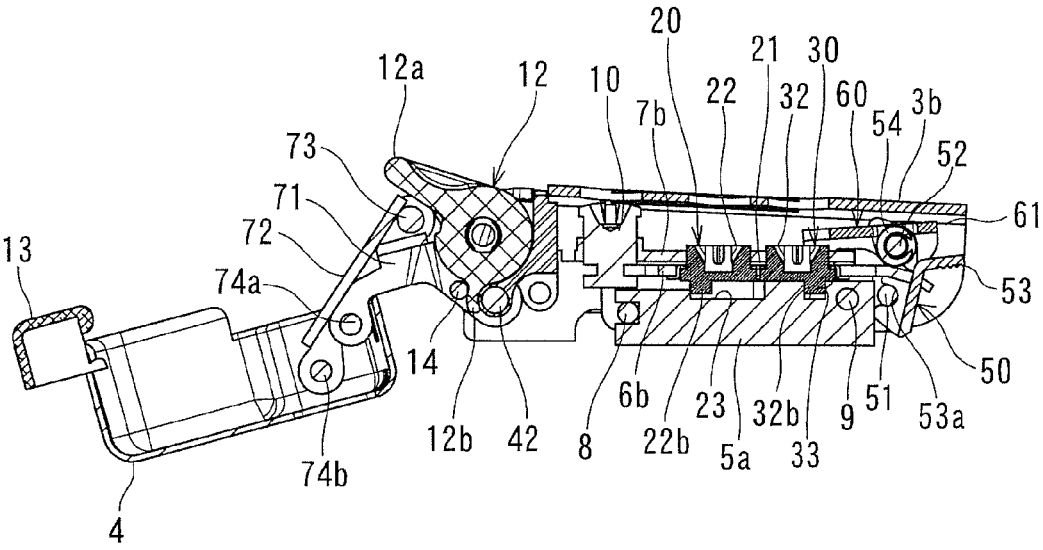
FIG. 6 is a cross-sectional view, taken along line X-X of FIG. 5.
Figure 7:
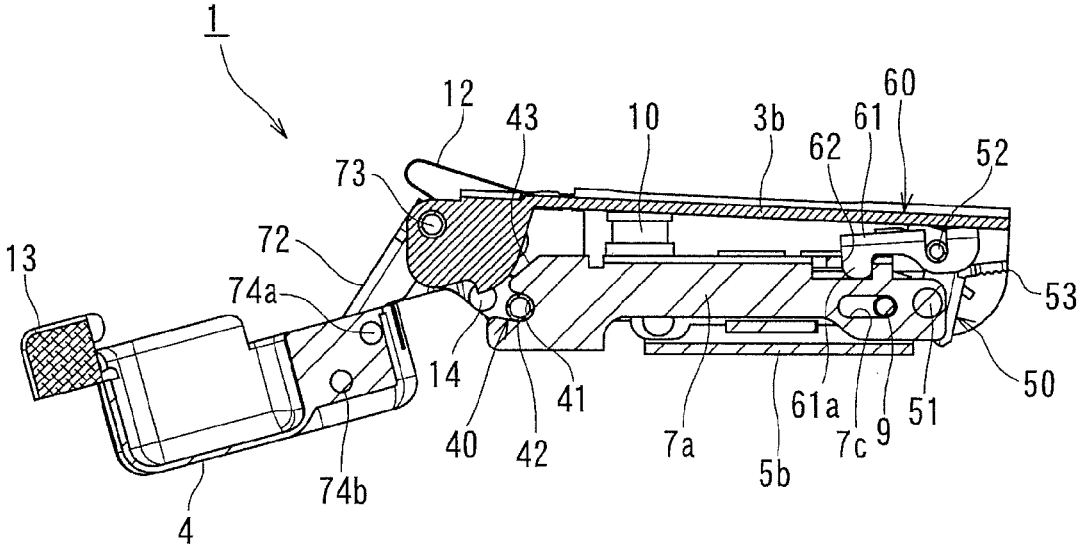
FIG. 7 is a cross-sectional view, taken along line Y-Y of FIG. 5.
Figure 8:
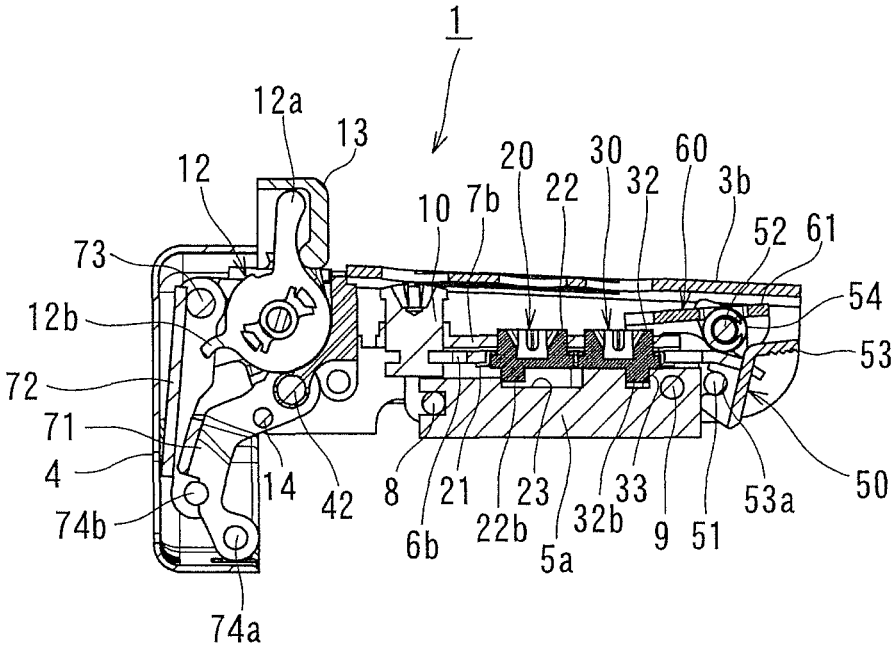
FIG. 8 is a cross-sectional view of the first embodiment similar to FIG. 6, showing the mounting member in a closed position.
Figure 9:
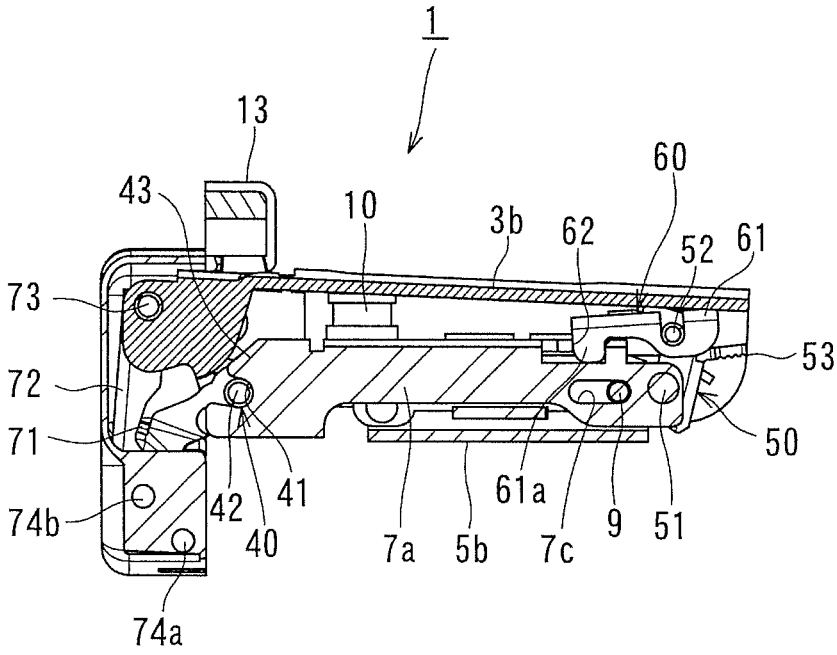
FIG. 9 is a cross-sectional view of the first embodiment similar to FIG. 7, showing the mounting member in the closed position.

A rotational biasing unit 12 having a damper mechanism disposed therein is provided in the front end portion of the body 3. The rotational biasing unit 12 is designed such that biasing directions can be switched when the mounting member 4 is at a predetermined intermediate position between the closed position and the open position. Specifically, when the mounting member 4 is at a position between the closed position and the intermediate position, the rotational biasing unit 12 biases the mounting member 4 toward the closed position. On the other hand, when the mounting member 4 is at a position between the intermediate position and the open position, the rotational biasing unit 12 biases the mounting member 4 toward the open position. Moreover, when the mounting member 4 is rotated from the intermediate position toward the closed position and reaches a position a predetermined angle (30 degrees, for example) before the closed position, a first projection 12*a* of the rotational biasing unit 12 is abutted against a stopper 13 provided in the mounting member 4 and the damper mechanism disposed in the rotational biasing unit 12 controls a speed of rotation of the mounting member 4 toward the closed position at a low speed. This prevents the door D from hitting the front door of the frame B at a high speed. When the mounting member 4 is rotated in an opening direction and reaches the open position, a second projection 12*b* of the rotational biasing unit 12 is abutted against a stopper shaft 14 provided in the internal link 71 as shown in FIG. 6. The open position of the mounting member 4 is determined by the abutment of the second projection 12*b* against the stopper shaft 14.

In the hinge device 1 having the features described above, the position of the body 3 can be adjusted in the vertical direction by rotating the first adjustment shaft 22 and the position of the body 3 can be adjusted in the front-rear direction by rotating the second adjustment shaft 32. The first and second adjustment shafts 22, 32 may be rotated with a screw driver, for example. In this case, the first and second adjustment shafts 22, 32 can be rotated easily and accurately through a desired angle by using a screw driver with a handle whose outer diameter is greater than an amount of decentering of the first and second eccentric shafts 22*b*, 32*b*. Therefore, the position of the first movable member 6 in the vertical direction and the position of the second movable member 7 in the front-rear direction can be easily and accurately adjusted, and consequently the position of the body 3 in the vertical direction and in the front-rear direction can be easily and accurately adjusted.

Other embodiments of the present invention will be described hereinafter. In the embodiments described below, only features different from the first embodiment will be described. The same components will be denoted by the same reference signs and description thereof will be omitted.

FIGS. 29 to 33 show a second embodiment of the present invention. In a hinge device 1A of the second embodiment, another third engagement mechanism 60A is adopted in place of the third engagement mechanism 60 of the first embodiment. The third engagement mechanism 60A has the following features.

Guide grooves 63 extending in the left-right direction (vertical direction in FIG. 32) are respectively formed in rear end portions of the side plates 3*a*, 3*a* of the body 3. Opposite end portions of a shaft (third engagement member) 64 are respectively disposed in the guide grooves 63, 63. The shaft 64 is disposed with a longitudinal direction thereof oriented in the vertical direction. The shaft 64 has a circular cross-section. The opposite end portions of the shaft 64 are respectively disposed in the guide grooves 63, 63 such that the shaft 64 is movable in the longitudinal direction but non-movable in a width direction (front-rear direction) of the guide grooves 63. The shaft 64 is biased by the torsion coil spring 54 in a direction from left ends of the guide grooves 63, 63 toward right ends of the guide grooves 63, 63.

A lock groove 65 is formed in rear end portions of the side plates 7*a*, 7*a* and the top plate 7*b* of the second movable member 7. The lock groove 65 extends in the left-right direction between the side plates 7*a*, 7*a* through the entire depth of the top plate 7*b* from an outer surface of the top plate 7*b* to an inner surface of the top plate 7*b*. Opposite side surfaces of the lock groove 65 are respectively flat surfaces extending in a direction orthogonal to the front-rear direction. A distance between the opposite side surfaces of the lock groove 65 is generally the same as an outer diameter of the shaft 64. A depth of the lock groove 65 is the same as or slightly greater than the outer diameter of the shaft 64. Therefore, when the shaft 64 enters deep into the lock groove 65 until the shaft 64 is abutted against a bottom surface of the lock groove 65 (the position of the shaft 64 at this moment is a locked position), the shaft 64 is prohibited from moving in the front-rear direction by the opposite side surfaces of the lock groove 65.

The shaft 64 and the lock groove 65 are disposed such that regardless of which of the first to the third methods is used to attach the body 3 to the second movable member 7, the shaft 64 is abutted against the top plate 7*b* until the attaching operation is completed and the shaft 64 enters the lock groove 65 when the attaching operation is completed. Therefore, while the body 3 is being attached to the second movable member 7, the shaft 64 is moved away from the locked position against the biasing force of the torsion coil spring 54 by being abutted against the top plate 7*b*. When the body 3 is correctly attached to the second movable member 7, the shaft 64 enters the lock groove 65. The body 3 is prohibited from moving forward with respect to the second movable member 7 by this arrangement.

Figure 34:
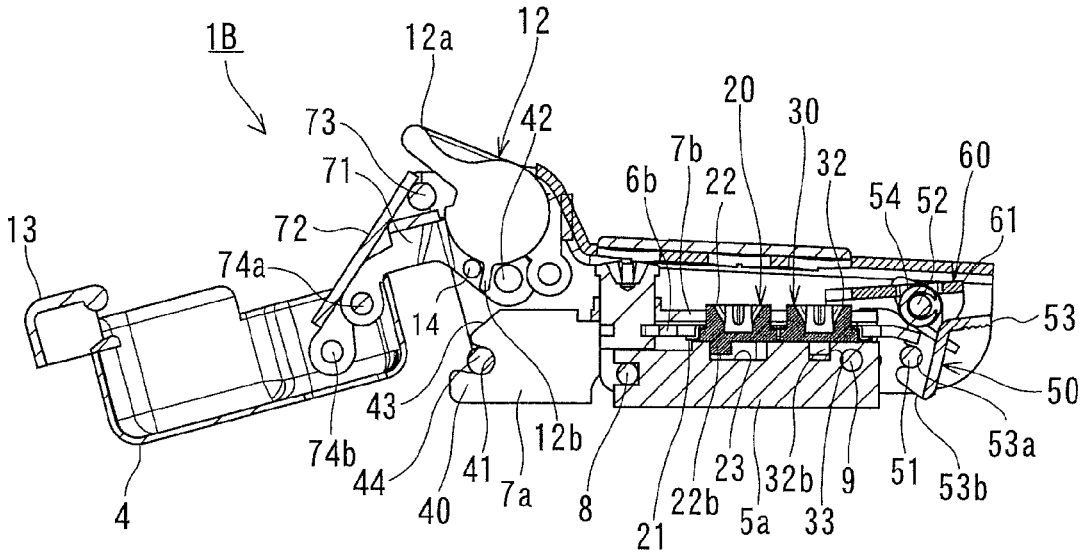
FIG. 34 is a cross-sectional view of a third embodiment of the present invention, corresponding to FIG. 6.

FIG. 34 shows a third embodiment of the present invention. In the hinge device 1B of the third embodiment, front end portions of the side plates 3*a*, 3*a* and the top plate 3*b* of the body 3 are protruded in a direction away from the base member 5, i.e., leftwards (upwards in FIG. 34). The first rotational shaft 42 and the second rotational shaft 73 are provided in the protruded front end portions of the side plates 3*a*, 3*a* and the top plate 3*b*. A first engagement shaft 44 serving as a first engagement member of the first engagement mechanism 40 is provided in a fixed manner in a right end portion of the front end portion of the side plates 3*a*, 3*a*. The front end portion of the body 3 is removably attached to the front end portion of the second movable member 7 by removable engagement of the first engagement shaft 44 with the first engagement recess 41.

The first engagement shaft 44 is disposed anterior to the first rotational shaft 42. The engagement shaft 51 is disposed posterior to the first rotational shaft 42. Accordingly, the first engagement shaft 44 and the engagement shaft 51 support a weight of the door D acting on the front end portion of the body 3 at two spaced points. Therefore, the door D having a heavy weight can be supported.

It is to be understood that the present invention is not limited to the embodiments described above, and various modifications may be adopted without departing from the spirit or scope of the invention.

For example, while the first engagement mechanism 40 is disposed between the front end portion of the body 3 and the front end portion of the second movable member 7 and the second engagement mechanism 50 is disposed between the rear end portion of the body 3 and the rear end portion of the second movable member 7 in the embodiments described above, the first engagement mechanism 40 may be disposed between the rear end portion of the body 3 and the rear end portion of the second movable member 7 and the second engagement mechanism 50 may be disposed between the front end portion of the body 3 and the front end portion of the second movable member 7.

Moreover, the first engagement recess 41 and the first rotational shaft 42 may be disposed vice-versa as with well-known hinge devices. Specifically, in place of the first engagement recess 41, a first engagement recess may be formed in the front end portion of the body 3. In this case, the first engagement recess is open rearward. Moreover, in place of the inclined surface 43, an inclined surface is formed in a portion of the body 3 continuing from the first engagement recess toward the second movable member 7. The inclined surface is inclined such that a front portion of the inclined surface is closer to the second movable member 7 than a rear portion of the inclined surface. On the other hand, a first engagement shaft (first engagement member) removably insertable to and from the first engagement recess through the opening thereof is provided in the front end portion of the second movable member 7.

Similarly, in the first position adjustment mechanism 20 and the second position adjustment mechanism 30, the first adjustment shafts 22, 32 may be provided in the base member 5 and the first and second adjustment recesses 23, 33 may be respectively provided in the first and second movable members 6, 7.

Moreover, while in the embodiments described above, the first adjustment shaft 22 and the second adjustment shaft 32 are relatively non-movably connected to each other via the guide plate 21, the first adjustment shaft 22 and the second adjustment shaft 32 may be relatively movable in the vertical direction and in the front-rear direction. In this case, the guide plate 21 is not required.

INDUSTRIAL APPLICABILITY

The hinge device and the base therefor according to the present invention may be used for rotatably connecting a door to a frame.

REFERENCE SINGS LIST

1 hinge device
1A hinge device
1B hinge device
2 base
3 body
4 mounting member
5 base member
6 first movable member
7 second movable member
20 first position adjustment mechanism
21 guide plate (guide member)
22 first adjustment shaft
22*b* first eccentric shaft
23 first adjustment recess (first adjustment engagement portion)
30 second position adjustment mechanism
32 second adjustment shaft
32*b* second eccentric shaft
33 second adjustment recess (second adjustment engagement portion)

The invention claimed is:

1. A hinge device comprising:

a base;

a body removably provided at the base; and a mounting member rotatably connected to the body;

the base comprising:

a base member;

a first movable member disposed at the base member such that the first movable member is movable in a first direction and non-movable in a second direction orthogonal to the first direction with respect to the base member; and a second movable member disposed at the first movable member such that the second movable member is movable in the second direction and non-movable in the first direction with respect to the first movable member; and the body removably attached to the second movable member, wherein a first position adjustment mechanism is provided between the base member and the first movable member, the first position adjustment mechanism adjusts position of the first movable member with respect to the base member in the first direction, a second position adjustment mechanism is provided between the base member and the second movable member, the second position adjustment mechanism adjusts position of the second movable member with respect to the base member in the second direction;

the first position adjustment mechanism comprises a first adjustment shaft and a first adjustment engagement portion, the first adjustment shaft is provided at the first movable member such that the first adjustment shaft is rotatable about a first rotational axis extending in a third direction orthogonal to the first direction and the second direction and the first adjustment shaft is non-movable in the first direction with respect to the first movable member, the first adjustment engagement portion is provided in the base member, a first eccentric shaft decentered with respect to the first rotational axis is provided at the first adjustment shaft, the first eccentric shaft is engaged with the first adjustment engagement portion such that the first eccentric shaft is non-movable in the first direction and movable in the second direction with respect to the base member;

the second position adjustment mechanism comprises a second adjustment shaft and a second adjustment engagement portion, the second adjustment shaft is provided at the second movable member such that the second adjustment shaft is rotatable about a second rotational axis extending parallel to the first rotational axis and the second adjustment shaft is non-movable in the second direction with respect to the second movable member, the second adjustment engagement portion is provided in the base member, a second eccentric shaft decentered with respect to the second rotational axis is provided at the second adjustment shaft, the second eccentric shaft is engaged with the second adjustment engagement portion such that the second eccentric shaft is movable in the first direction and non-movable in the second direction with respect to the base member; and, a guide member is provided at the first movable member such that the guide member is non-movable in the first direction and movable in the second direction with respect to the first movable member.

2. The hinge device according to claim 1, wherein the first adjustment shaft is movable in the second direction with respect to the first movable member, and the first adjustment shaft and the second adjustment shaft are connected to each other such that the first adjustment shaft and the second adjustment shaft are non-movable with respect to each other in the second direction.

3. The hinge device according to claim 2, wherein the first adjustment shaft is provided at the guide member such that the first adjustment shaft is rotatable about the first rotational axis and non-movable in the first direction and in the second direction with respect to the guide member, and the second adjustment shaft is provided at the guide member such that the second adjustment shaft is rotatable about the second rotational axis and non-movable in the first direction and in the second direction with respect to the guide member.

4. The hinge device according to claim 3, wherein the guide member is movable in the second direction with respect to the first movable member with a frictional resistance of a predetermined magnitude working between the guide member and the first movable member.

5. A base for a hinge device comprising:

a base member;

a first movable member disposed at the base member such that the first movable member is movable in a first direction and non-movable in a second direction orthogonal to the first direction with respect to the base member; and a second movable member disposed at the first movable member such that the second movable member is movable in the second direction and non-movable in the first direction with respect to the first movable member; and a body removably attached to the second movable member, the body having a mounting member rotatably connected to the body, wherein a first position adjustment mechanism is provided between the base member and the first movable member, the first position adjustment mechanism adjusts position of the first movable member with respect to the base member in the first direction, a second position adjustment mechanism is provided between the base member and the second movable member, the second position adjustment mechanism adjusts position of the second movable member with respect to the base member in the second direction;

the first position adjustment mechanism comprises a first adjustment shaft and a first adjustment engagement portion, the first adjustment shaft is provided at the first movable member such that the first adjustment shaft is rotatable about a first rotational axis extending in a third direction orthogonal to the first direction and the second direction and the first adjustment shaft is non-movable in the first direction with respect to the first movable member, the first adjustment engagement portion is provided in the base member, a first eccentric shaft decentered with respect to the first rotational axis is provided at the first adjustment shaft, the first eccentric shaft is engaged with the first adjustment engagement portion such that the first eccentric shaft is non-movable in the first direction and movable in the second direction with respect to the base member;

the second position adjustment mechanism comprises a second adjustment shaft and a second adjustment engagement portion, the second adjustment shaft is provided at the second movable member such that the second adjustment shaft is rotatable about a second rotational axis extending parallel to the first rotational axis and the second adjustment shaft is non-movable in the second direction with respect to the second movable member, the second adjustment engagement portion is provided in the base member, a second eccentric shaft decentered with respect to the second rotational axis is provided at the second adjustment shaft, the second eccentric shaft is engaged with the second adjustment engagement portion such that the second eccentric shaft is movable in the first direction and non-movable in the second direction with respect to the base member; and, a guide member is provided at the first movable member such that the guide member is non-movable in the first direction and movable in the second direction with respect to the first movable member.

6. The base for a hinge device according to claim 5, wherein the first adjustment shaft is movable in the second direction with respect to the first movable member, and the first adjustment shaft and the second adjustment shaft are connected to each other such that the first adjustment shaft and the second adjustment shaft are non-movable with respect to each other in the second direction.

7. The base for a hinge device according to claim 6, wherein the first adjustment shaft is provided at the guide member such that the first adjustment shaft is rotatable about the first rotational axis and non-movable in the first direction and in the second direction with respect to the guide member, and the second adjustment shaft is provided at the guide member such that the second adjustment shaft is rotatable about the second rotational axis and non-movable in the first direction and in the second direction with respect to the guide member.

8. The base for a hinge device according to claim 7, wherein the guide member is movable in the second direction with respect to the first movable member with a frictional resistance of a predetermined magnitude working between the guide member and the first movable member.

* * * * *